US011655066B2

(12) United States Patent
Couture et al.

(10) Patent No.: US 11,655,066 B2
(45) **Date of Patent: *May 23, 2023**

(54) RETAIL READY CONTAINERS

(71) Applicant: WestRock Shared Services, LLC, Atlanta, GA (US)

(72) Inventors: David G. Couture, Hoschton, GA (US); Kevin M. Simpkins, Cumming, GA (US)

(73) Assignee: WestRock Shared Services, LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/548,384

(22) Filed: Dec. 10, 2021

(65) Prior Publication Data

US 2022/0097903 A1 Mar. 31, 2022

Related U.S. Application Data

(63) Continuation-in-part of application No. 16/796,377, filed on Feb. 20, 2020, now Pat. No. 11,198,535.

(51) Int. Cl.

| | |
|---|---|
| ***B65D 5/54*** | (2006.01) |
| ***B65D 5/468*** | (2006.01) |
| ***B65D 5/02*** | (2006.01) |
| ***B65D 77/04*** | (2006.01) |
| *B31B 50/62* | (2017.01) |
| *B31B 120/30* | (2017.01) |
| *B31B 50/26* | (2017.01) |
| *B31B 50/20* | (2017.01) |

(52) U.S. Cl.

CPC ..... *B65D 5/542* (2013.01); *B65D 5/0227* (2013.01); *B65D 5/4608* (2013.01); *B65D 77/042* (2013.01); *B31B 50/20* (2017.08); *B31B 50/262* (2017.08); *B31B 50/624* (2017.08); *B31B 2120/302* (2017.08); *B65D 2577/043* (2013.01)

(58) Field of Classification Search

CPC ..... B65D 25/005; B65D 5/5495; B65D 5/54; B65D 5/5445; B65D 5/725; B65D 5/5415; B65D 5/0236; B65D 5/542

USPC ..... 206/774, 746, 736, 738; 229/164, 235, 229/242, 103, 117.16, 160.2, 240, 224; 220/23.83

See application file for complete search history.

(56) References Cited

U.S. PATENT DOCUMENTS

| | | | | |
|---|---|---|---|---|
| 5,582,345 | A * | 12/1996 | Lankhuijzen | B65D 5/5445 229/242 |
| 5,979,749 | A | 11/1999 | Bozich | |
| 8,752,708 | B2 | 6/2014 | Keefe | |
| 10,781,011 | B2 * | 9/2020 | Rose | B65D 5/52 |

(Continued)

*Primary Examiner* — Christopher R Demeree
(74) *Attorney, Agent, or Firm* — Rohini K. Garg

(57) ABSTRACT

A blank for constructing a container includes a front panel, a bottom panel foldably connected to the front panel along a lower front horizontal fold line, and a side panel having a front portion and a rear portion. The side panel is foldably connected to at least one of the bottom panel or the front panel. The blank includes a top panel that is foldably connected to the side panel, and a rear panel foldably connected to the rear portion of the side panel along a rear vertical fold line. The front and rear portions of the side panel are separable from one another along a separation line such that the rear portion of the side panel and the rear panel are configured and adapted for removal.

20 Claims, 31 Drawing Sheets

(56) References Cited

U.S. PATENT DOCUMENTS

| | | | | |
|---|---|---|---|---|
| 10,836,532 | B2 * | 11/2020 | Djokovic | B65D 5/5495 |
| 2002/0043554 | A1 | 4/2002 | White et al. | |
| 2010/0206944 | A1 * | 8/2010 | Bates | B65D 5/542<br>220/23.83 |
| 2010/0276333 | A1 * | 11/2010 | Couture | B65D 5/54<br>206/774 |
| 2011/0049226 | A1 | 3/2011 | Moreau et al. | |
| 2011/0284621 | A1 | 11/2011 | Couture | |
| 2013/0306718 | A1 | 11/2013 | Sumpmann et al. | |
| 2019/0016501 | A1 | 1/2019 | Djokovic et al. | |

* cited by examiner

Fig. 6
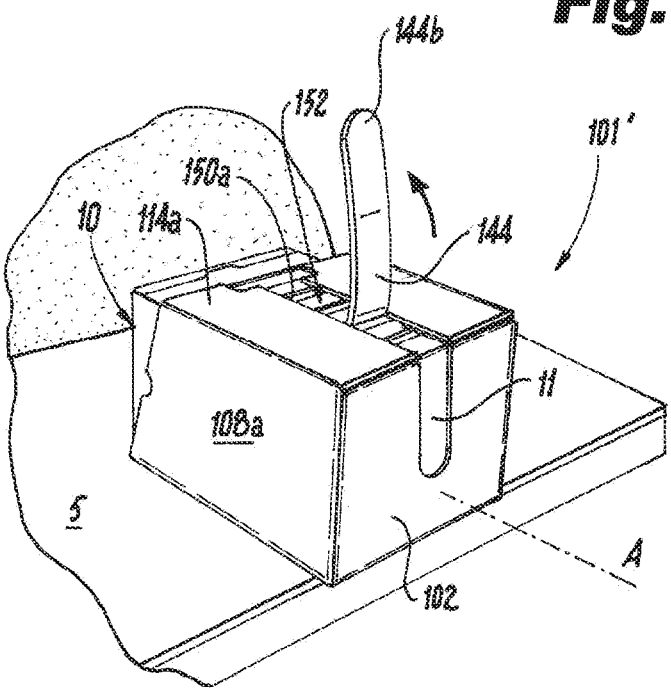
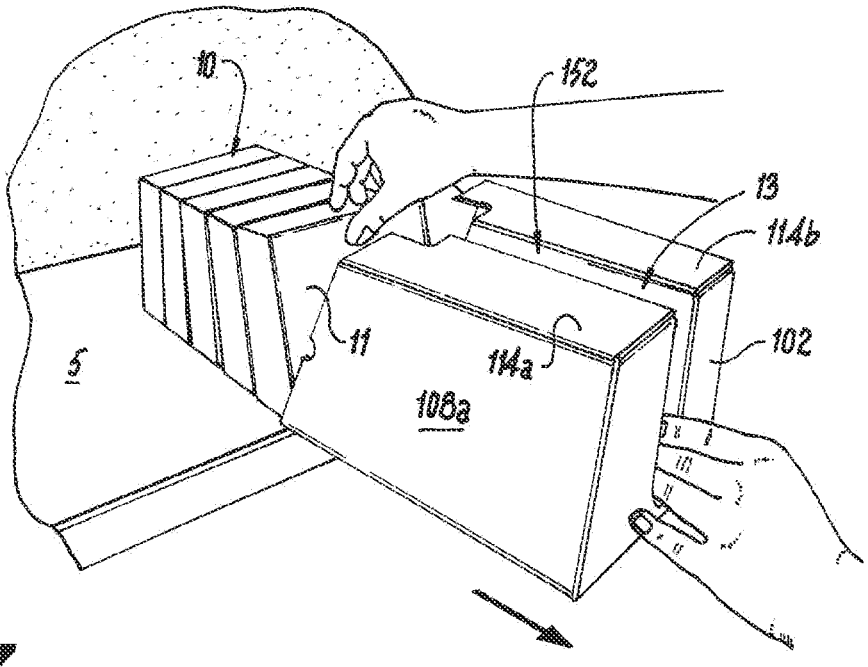
Fig. 7

Fig. 9A
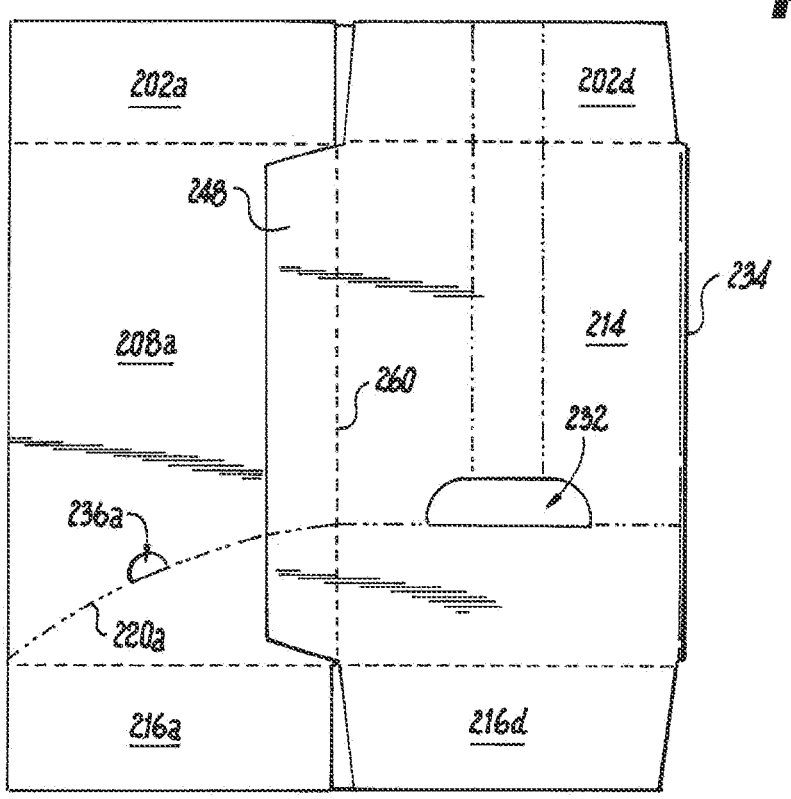
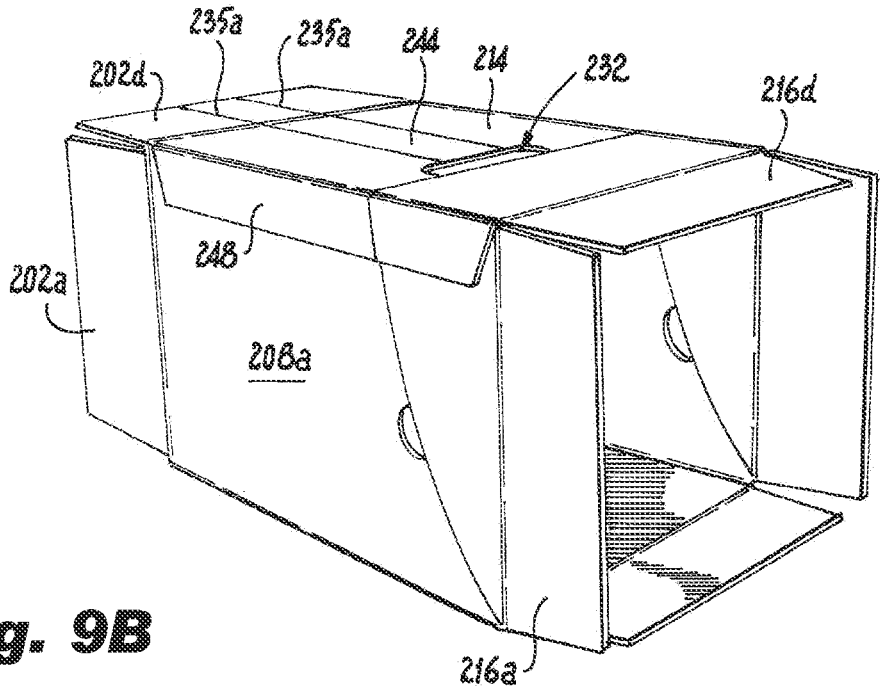
Fig. 9B

Fig. 11
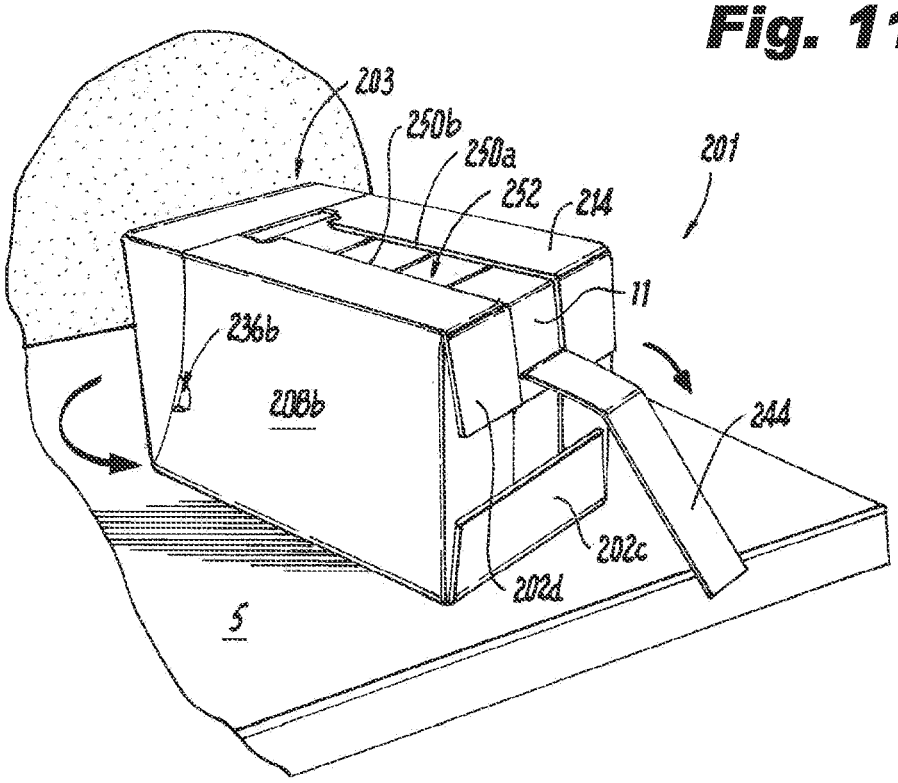
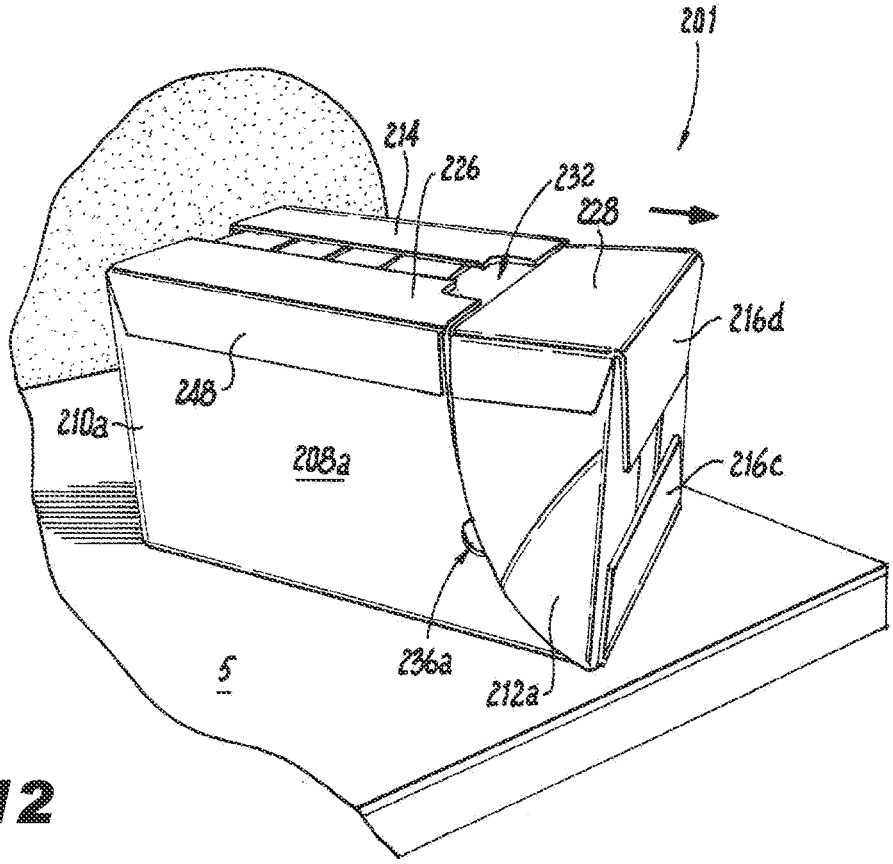
Fig. 12

Fig. 23
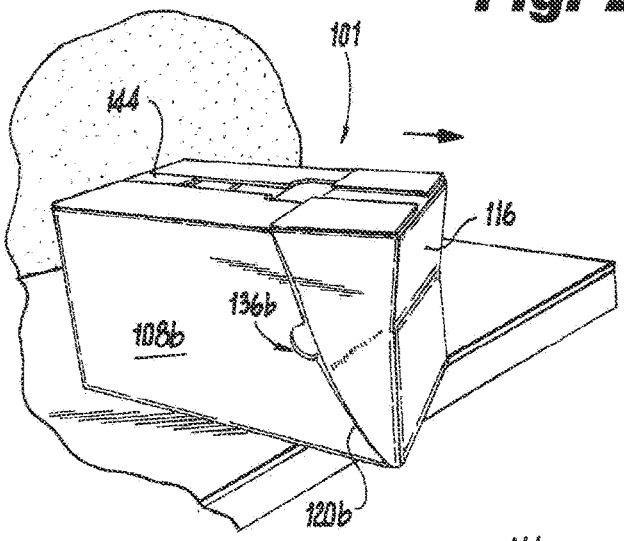
Fig. 24
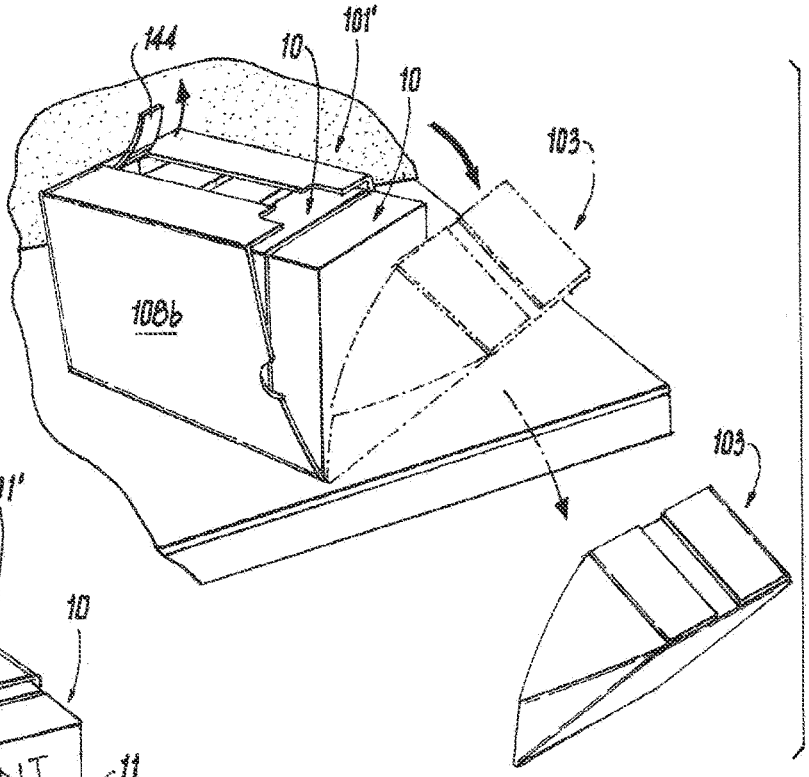
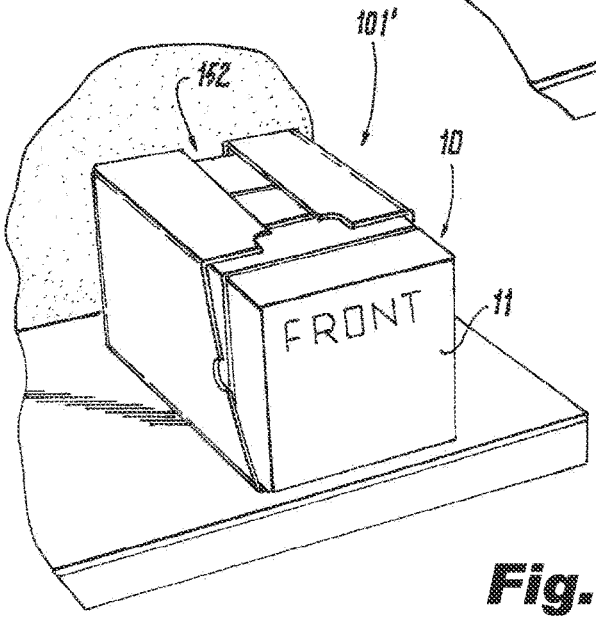
Fig. 25

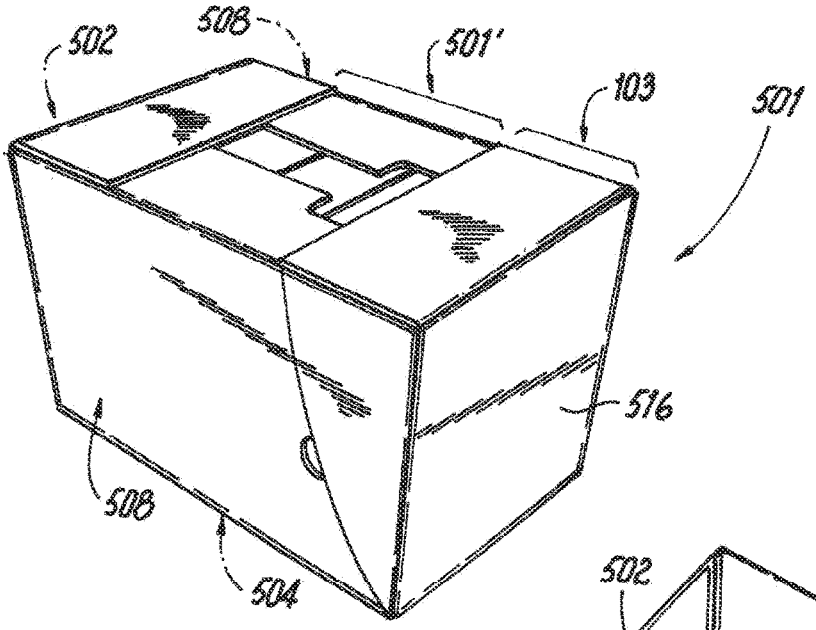
Fig. 27
Fig. 28
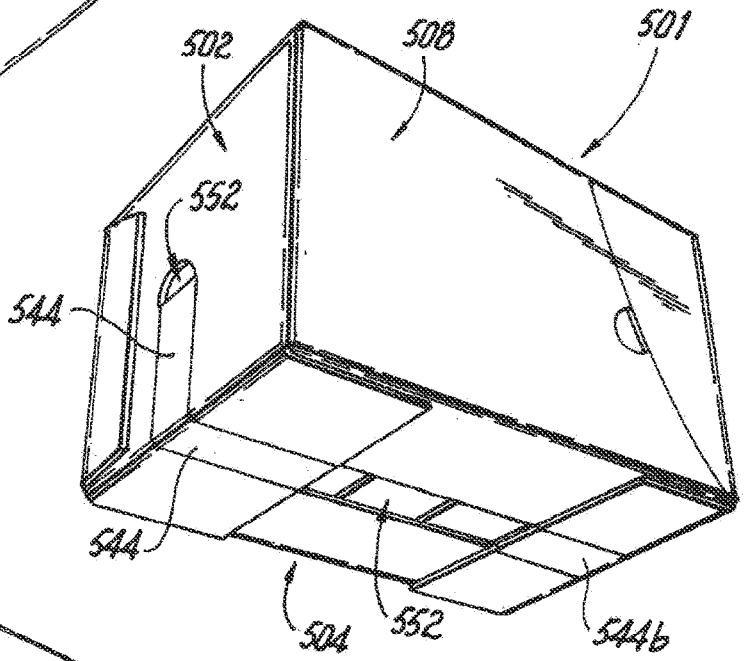
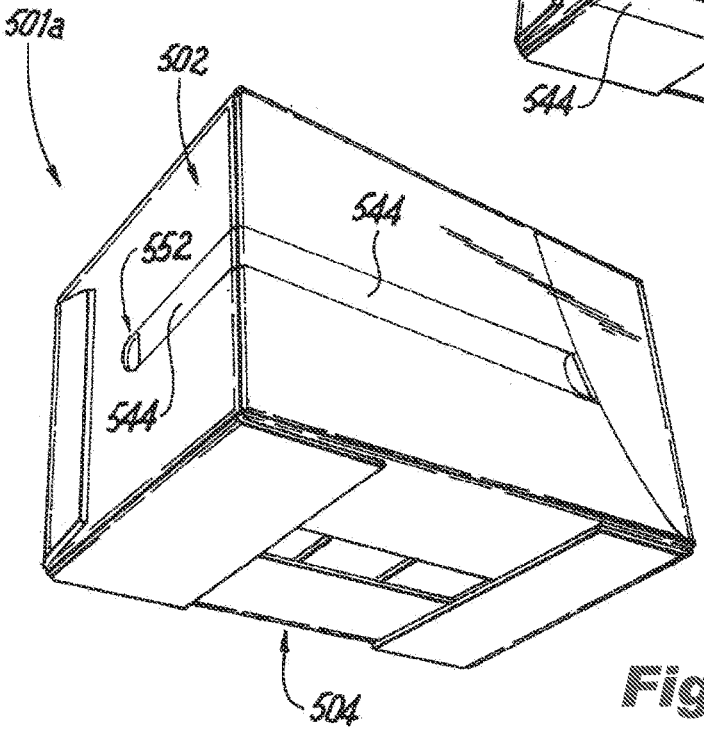
Fig. 28a

Fig. 31
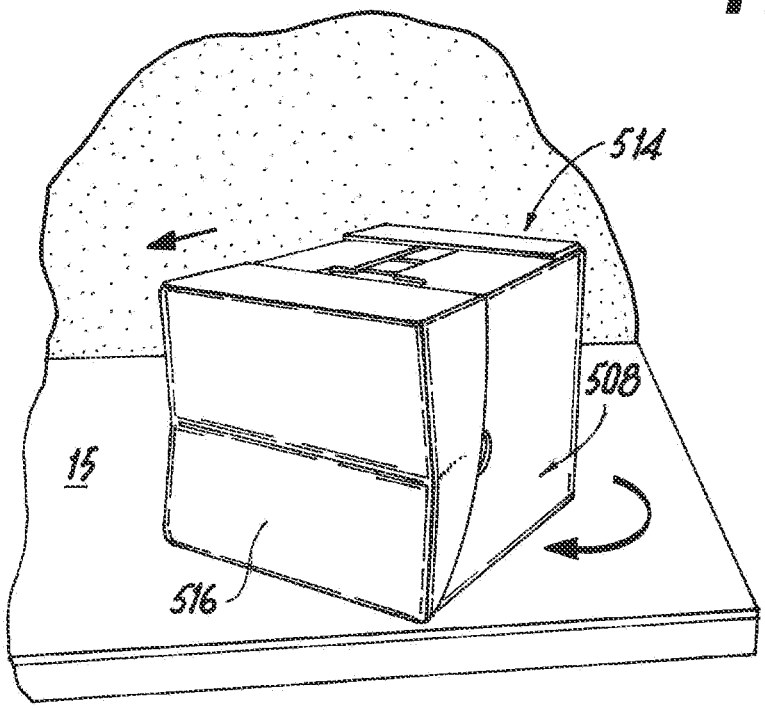
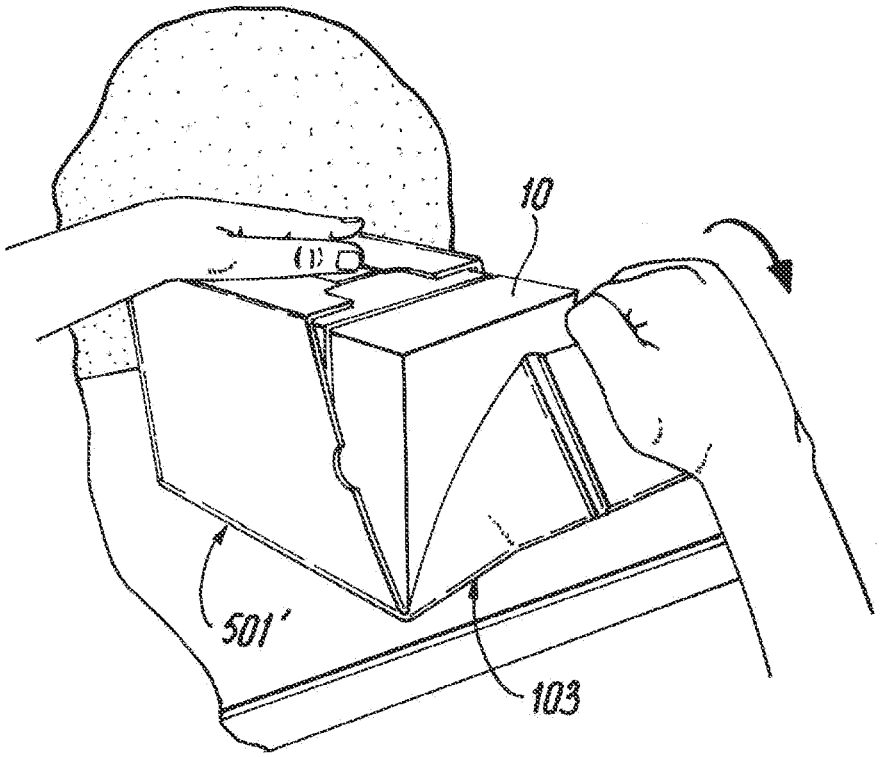
Fig. 32

Fig. 33
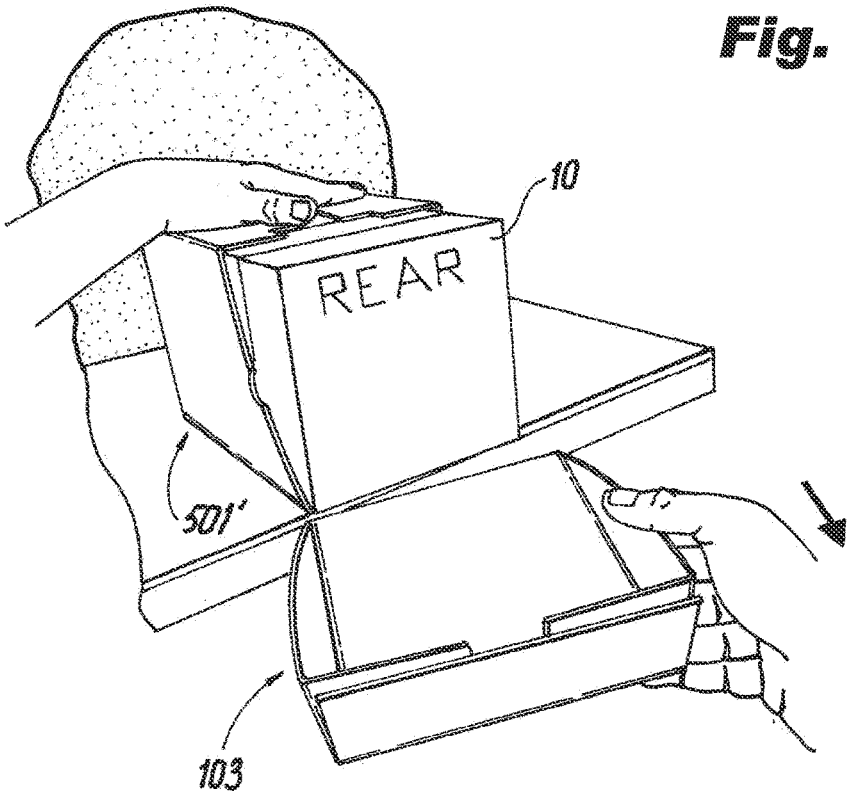
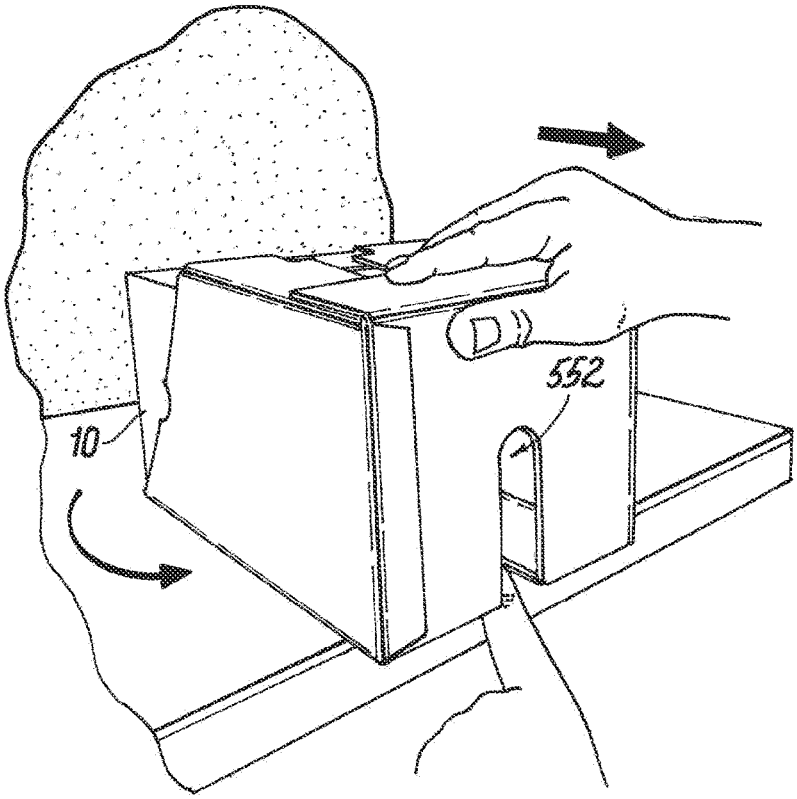
Fig. 34

Fig. 35
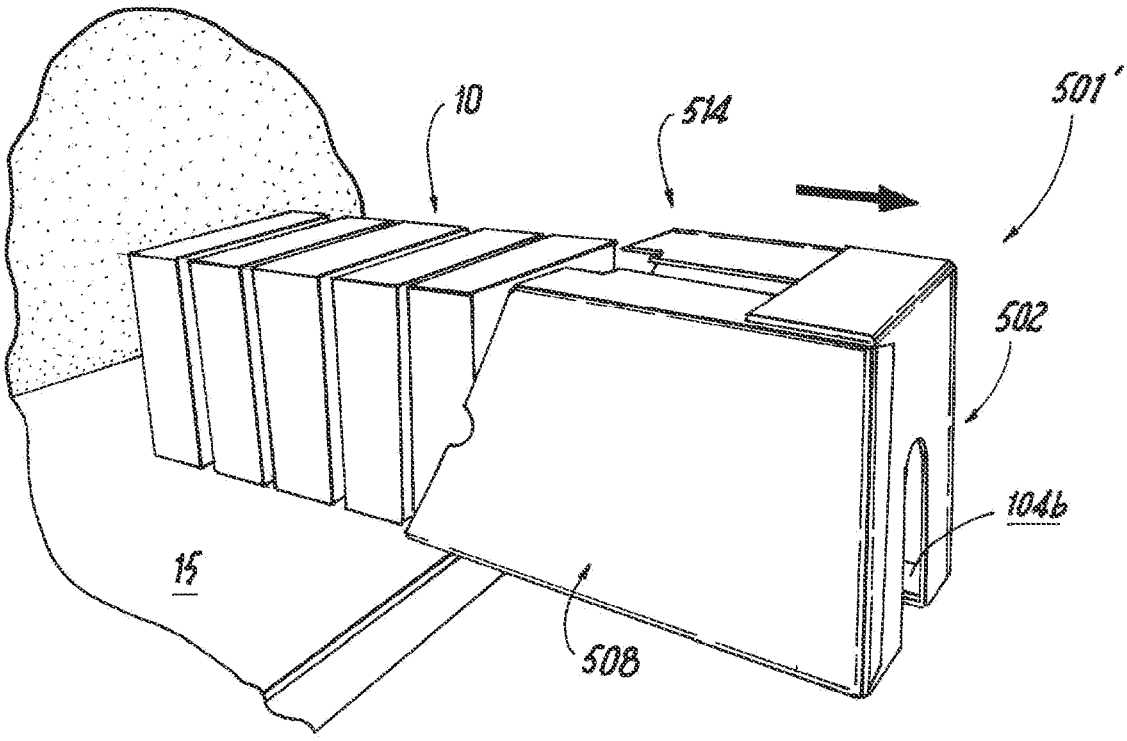
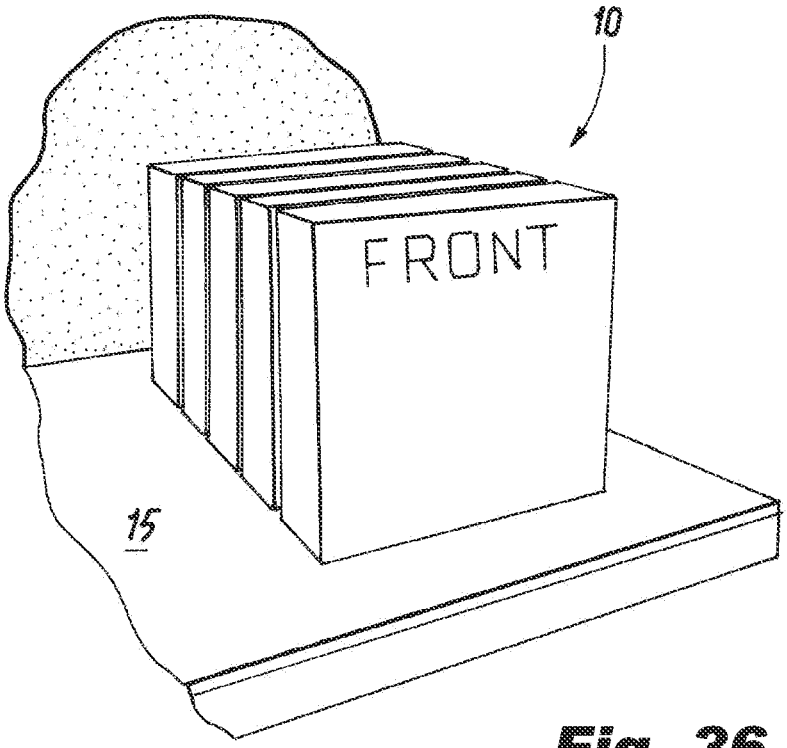
Fig. 36

Fig. 50
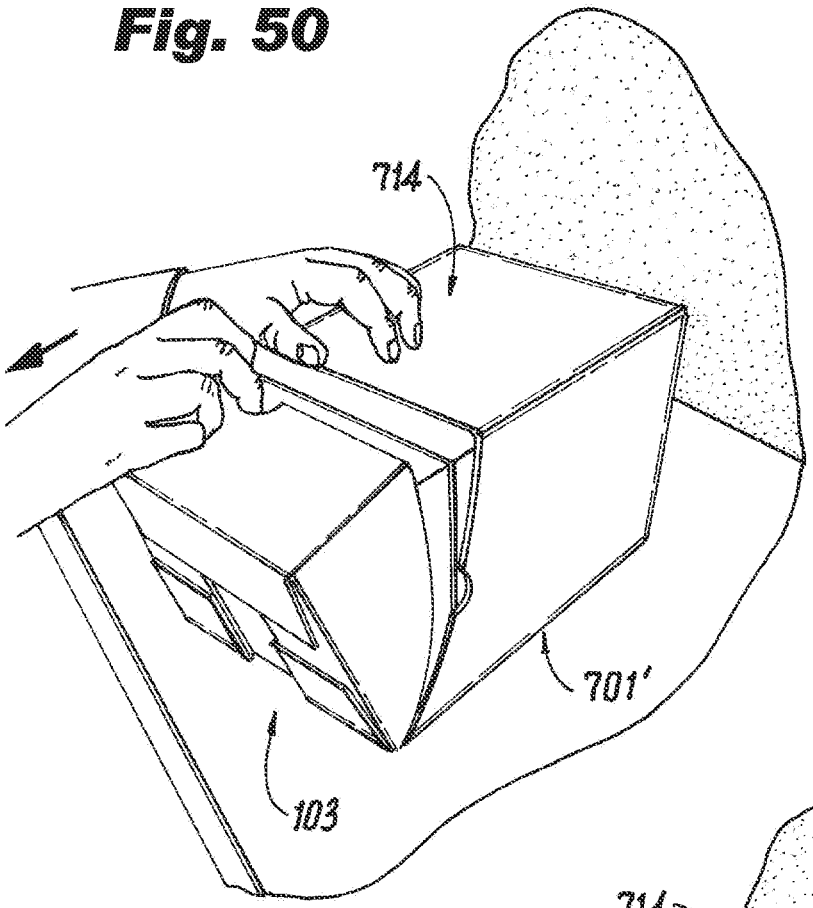
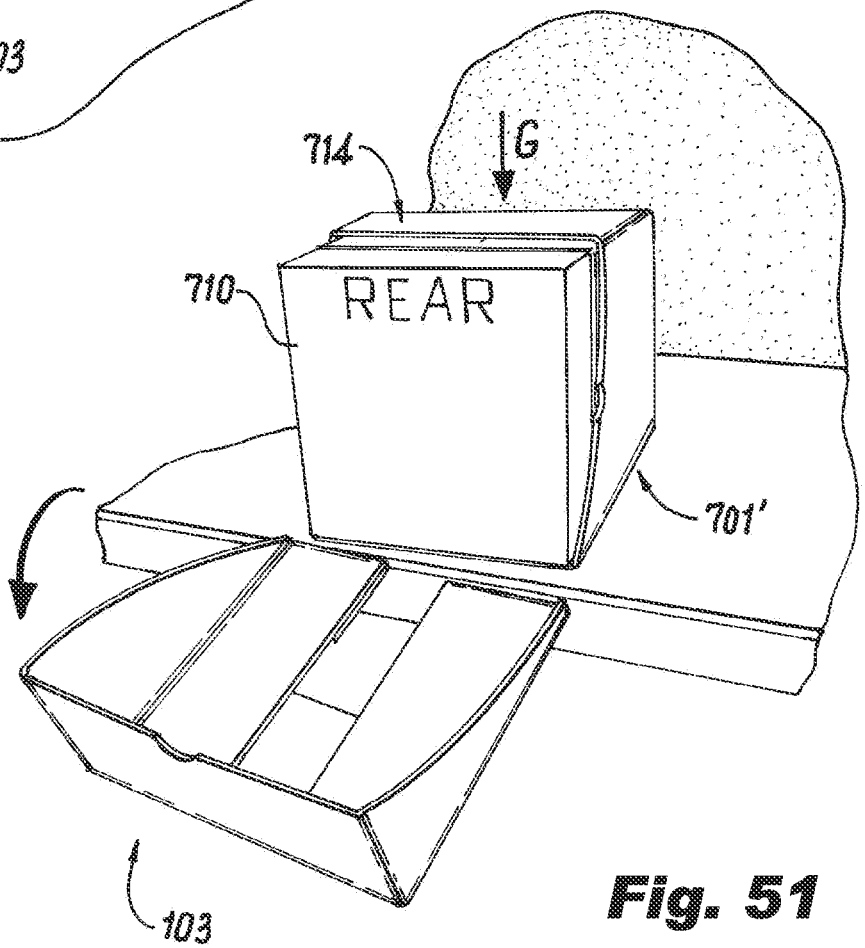
Fig. 51

RETAIL READY CONTAINERS

CROSS-REFERENCE TO RELATED APPLICATIONS

This application is a continuation-in-part of U.S. patent application Ser. No. 16/796,377, filed Feb. 20, 2020, the entire content of which is incorporated herein by reference.

BACKGROUND OF THE INVENTION

1. Field of the Invention

The present disclosure relates to containers, and more particularly to containers with removable panels for displaying product, e.g., in a retail setting.

2. Description of Related Art

Retailers, such as big-box stores, superstores and warehouse clubs sell large quantities of fast moving consumer goods. These retailers often want to have items shipped from their distribution centers to stores in unit loads and bulk boxes that can be stocked efficiently and without excessive handling of the merchandise. Conventional retail ready display containers can be used to ship product to a retail location. Once in the retail setting, the containers can be converted, e.g., by removing a panel from the container along a perforation line. Once the panel is removed, the product within the container is displayed and customers can access and remove product directly from the container. However, the tray portion of the container is typically left behind on the shelf.

The conventional techniques have been considered satisfactory for their intended purpose. However, there is an ever present need for improved containers. This disclosure provides a solution for this need.

SUMMARY OF THE INVENTION

A blank for constructing a container includes a front panel, a bottom panel foldably connected to the front panel along a lower front horizontal fold line, and a side panel having a front portion and a rear portion. The side panel is foldably connected to at least one of the bottom panel or the front panel. The blank includes a top panel that is foldably connected to the side panel, and a rear panel foldably connected to the rear portion of the side panel along a rear vertical fold line. The front and rear portions of the side panel are separable from one another along a separation line such that the rear portion of the side panel and the rear panel are configured and adapted for removal.

The rear panel can be foldably connected to the bottom panel along a separation line. The rear panel can be a first of a plurality of rear flaps. A second of the plurality of rear flaps can be foldably connected to the bottom panel along a separation line. The bottom panel can be a first of a plurality of bottom flaps. A second of the plurality of bottom flaps can be foldably connected to the rear panel along a separation line. The blank can include a finger hole in the side panel between the front portion and the rear portion. The top panel can be a first of a plurality of top flaps. The front panel can be a first of a plurality of front flaps. At least one of the front portion of the side panel or the front portion of the top panel can include a removable portion defined between two separation lines. The top panel can include a front portion and a rear portion separable from one another along a separation line. At least a portion of a handle hole can be defined between the front and rear portions of the top panel. The front and rear portions of the top panel can be connected to the front and rear portions of the side panel, respectively, along respective fold lines.

In accordance with another aspect, a container includes a plurality of panels connected together to enclose an interior space, wherein the plurality of panels include a front panel, a bottom panel foldably connected to the front panel along a lower front horizontal fold line, a side panel having a front portion and a rear portion, wherein the side panel is foldably connected to at least one of the bottom panel or the front panel, a top panel, wherein the top panel is foldably connected to the side panel, and a rear panel foldably connected to the rear portion of the side panel along a rear vertical fold line. The front and rear portions of the side panel are configured and adapted to be separated from one another along a separation line such that the rear portion of the side panel and the rear panel are configured and adapted for removal to provide access to the interior space.

The side panel can include a glue flap extending from and foldably connected to the front portion of the side panel. The glue flap can be adhered to an inside surface of the front panel. The top panel can include a glue flap extending from and foldably connected to the top panel. The glue flap can be adhered to an inside surface of the side panel. The top panel can be a first of a plurality of top flaps. The first of the plurality of top flaps and a second of the plurality of top flaps each define a terminal edge. A finger slot can be defined between the terminal edges of the first and second top flaps.

In accordance with another aspect, a method of forming a container from a blank includes folding a plurality of panels of the blank around an area to be enclosed by the container. The folding occurs at respective fold lines between panels of the blank to form an erected blank defining a product exit axis. The method includes folding a first set of bottom flaps attached to a bottom end of the erected blank and folding a second set of bottom flaps attached to the bottom end of the erected blank to enclose one end of the container. Each flap of the first set of bottom flaps defines a terminal edge. The terminal edge is parallel to the product loading axis.

In accordance with at least one aspect of this disclosure, a blank for constructing a container includes, a front panel, a bottom panel foldably connected to the front panel along a lower front horizontal fold line, a side panel having a front portion and a rear portion, wherein the side panel is foldably connected to at least one of the bottom panel or the front panel, a top panel wherein the top panel is foldably connected to the side panel, and a rear panel foldably connected to the rear portion of the side panel along a rear vertical fold line.

In embodiments, the front and rear portions of the side panel can be separable from one another along a separation line such that the rear portion of the side panel and the rear panel are configured and adapted for removal.

In certain embodiments, the rear panel is configured to form at least part of a rear wall in a formed container, the top panel is configured to form at least part of a top wall in the formed container, the front panel is configured to form at least part of a front wall in the formed container, the bottom panel is configured to form at least part of a bottom wall in the formed container, and the side panel is configured to form at least part of a side wall in the formed container.

In embodiments, an entirety of the rear wall can be configured and adapted for removal. In certain embodiments, the blank can be configured to define a finger slot in the formed container. In certain such embodiments, the finger slot can be configured to extend through at least one of the front wall, the top wall, the bottom wall, and/or the side wall to allow a user to access an interior of the formed container.

In embodiments, the rear panel can be foldably connected to the bottom panel along a separation line. In certain embodiments, the rear panel can be a first of a plurality of rear flaps, and a second of the plurality of rear flaps can be foldably connected to the bottom panel along a separation line. In embodiments, the bottom panel can be a first of a plurality of bottom flaps, and a second of the plurality of bottom flaps can be foldably connected to the rear panel along a separation line. In embodiments, the top panel can be a first of a plurality of top flaps, and in certain embodiments, the front panel can be a first of a plurality of front flaps.

In embodiments, at least one of the front portion of the side panel and/or a front portion of the bottom panel can include a removable portion defined between two separation lines. In embodiments, a finger hole in the side panel between the front portion of the side panel and the rear portion of the side panel. In embodiments, the removable portion can extend downward from the finger hole towards the bottom panel. The rear panel can be foldably connected to the bottom panel along a separation line and the separation line between the front and rear portions of the side panel can extend upward from the separation line on the bottom panel towards the top panel.

In embodiments, the top panel can include a front portion and a rear portion separable from one another along a separation line. In embodiments, at least a portion of a handle hole can be defined between the front and rear portions of the top panel. In embodiments, the front and rear portions of the top panel can connect to the front and rear portions of the side panel, respectively, along respective fold lines.

In certain embodiments, the bottom panel can be a first of a plurality of bottom flaps, and a second bottom flop can be foldably connected to the side panel, where the front portion of the top panel is longer the rear portion of the top panel, and a length of the second bottom flap is greater than a length of the front portion of the top panel. In embodiments, a length of the front portion of the side panel proximate the bottom panel can be greater than a length of the front portion of the side panel proximate the top panel.

In accordance with at least one aspect of this disclosure, a container can include a plurality of panels connected together to enclose an interior space. In embodiments, the plurality of panels can include a front panel, a bottom panel foldably connected to the front panel along a lower front horizontal fold line, a side panel having a front portion and a rear portion, wherein the side panel is foldably connected to at least one of the bottom panel or the front panel, a top panel, wherein the top panel is foldably connected to the side panel, and a rear panel foldably connected to the rear portion of the side panel along a rear vertical fold line.

In embodiments, the front and rear portions of the side panel can be configured and adapted to be separated from one another along a separation line such that the rear portion of the side panel and the rear panel are configured and adapted for removal to provide access to the interior space. The rear panel can form at least part of a rear wall, the top panel can form at least part of a top wall, the front panel can form at least part of a front wall, the bottom panel can form at least part of a bottom wall in the formed container, and the side panel can form at least part of a side wall in the formed container. In embodiments, an entirety of the rear wall can be configured and adapted for removal and the finger slot can be configured to extend through at least one of the top wall, the front wall, the bottom wall, and/or the side wall to allow a user to access the interior space.

In certain embodiments, the side panel includes a glue flap extending from and foldably connected to the front portion of the side panel where the glue flap can be adhered to an inside surface of the front panel or an outside surface of the font panel. In certain embodiments the top panel includes a glue flap extending from and foldably connected to the top panel where the glue flap is adhered to an inside surface of the side panel or an outside surface of the front panel. In certain embodiments, the bottom panel can include a first of a plurality of bottom flaps. In certain such embodiments, the first of the plurality of bottom flaps and a second of the plurality of bottom flaps can each define a terminal edge, where the finger slot can be defined between the terminal edges of the first and second bottom flaps.

In embodiments, the bottom panel can include a first of a plurality of bottom flaps, In certain such embodiments, the first bottom flap can be foldably connected to the side panel and a second bottom flap can be foldably connected to either of the front panel or the rear panel, wherein first bottom flap is closer to the interior space than the second bottom flap, such that a product held within the container rests atop the first bottom flap. In embodiments, both the finger slot and a product held within the container settle towards the bottom of the container relative to a direction of gravity.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein:

FIGS. 4-7 are schematic perspective views of the container of FIGS. 2A-2B, showing stages of using the container to facilitate retail display of the product;

FIG. 9A is a schematic perspective view of the blank of FIG. 8, showing stages of folding the blank into a container;

FIG. 9B is a schematic perspective view of the blank of FIG. 8, showing stages of erecting the blank into a container;

FIGS. 11-14 are schematic perspective views of the container of FIGS. 9A-9B, showing stages of using the container to facilitate retail display of the product;

FIGS. 23-25 are schematic perspective views of the container of FIGS. 2A-2B, showing stages of using the container to facilitate retail display of the product while leaving a remainder of the container on the shelf;

FIG. 27 is a schematic perspective view of the rear and top of a container of formed by the blank of FIG. 26, showing the erected container with product inside;

FIG. 28 is a schematic perspective view of the front and bottom of the container of formed by the blank of FIG. 26, showing the erected container with product inside;

FIG. 28A is a schematic perspective view of an alternate front and bottom of the container of formed by an alternate blank of FIG. 26, showing an erected container with product inside;

FIGS. 29-36 are schematic perspective views of the container of FIGS. 27-28, showing stages of using the container to facilitate retail display of the product;

FIGS. 48-53 are schematic perspective views of the container of FIGS. 46-47, showing stages of using the container to facilitate retail display of the product.

DETAILED DESCRIPTION OF THE PREFERRED EMBODIMENTS

Figure 1:
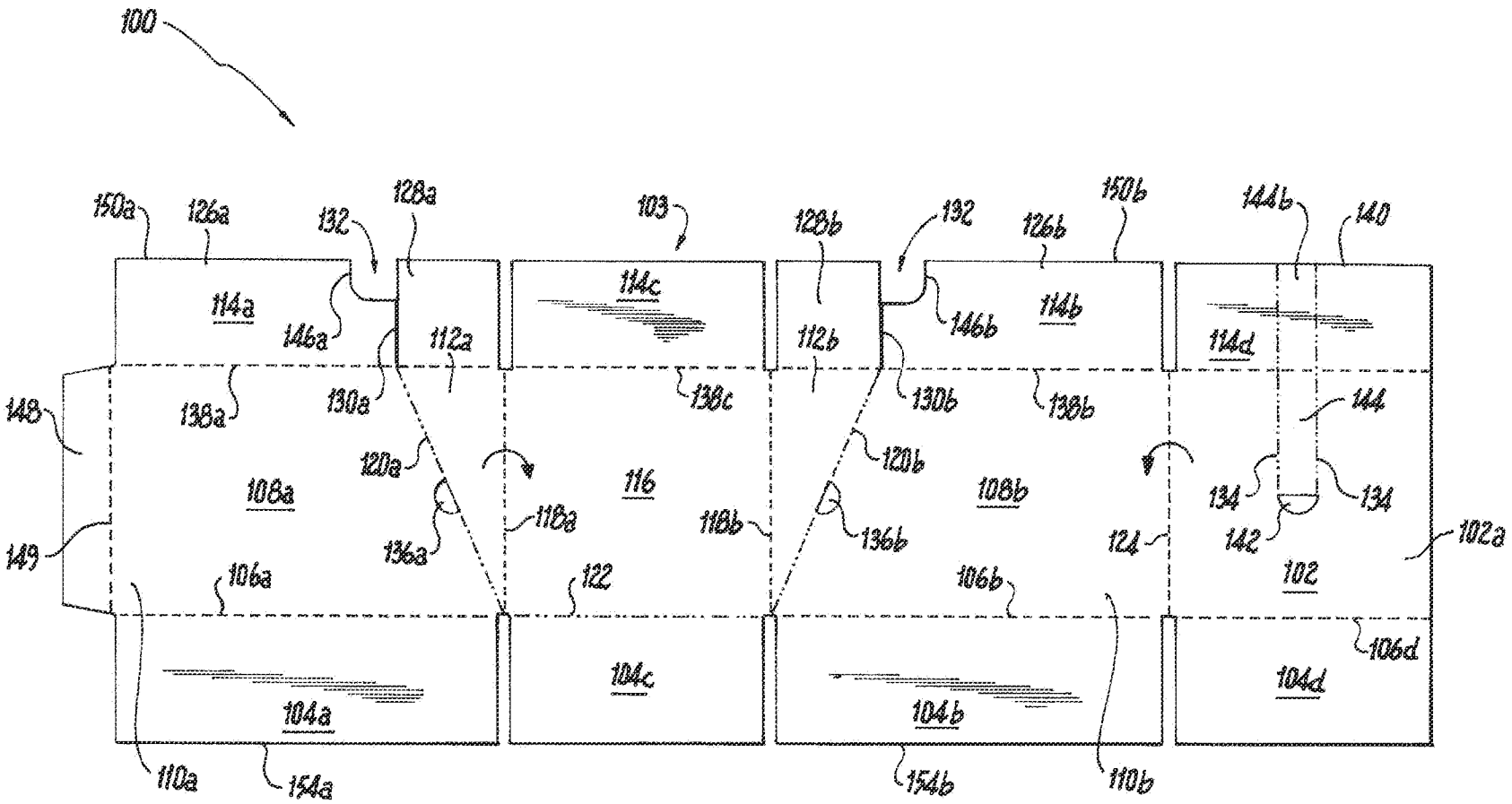
FIG. 1 is a schematic plan view of an embodiment of a blank constructed in accordance with the present disclosure, showing the interior surface of the blank with separation lines.
Figure 2A:
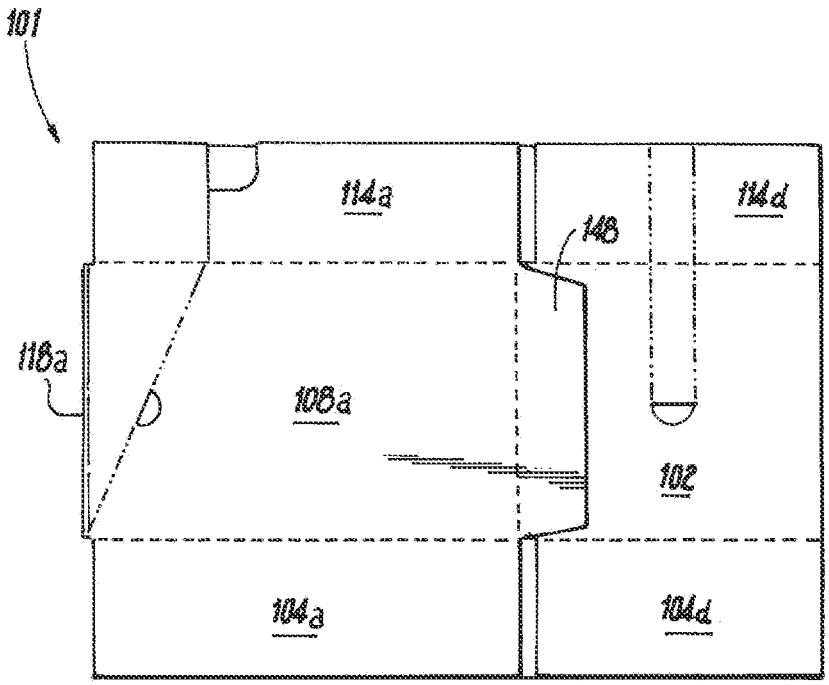
FIG. 2A is a schematic perspective view of the blank of FIG. 1, showing stages of folding the blank into a container.
Figure 2B:
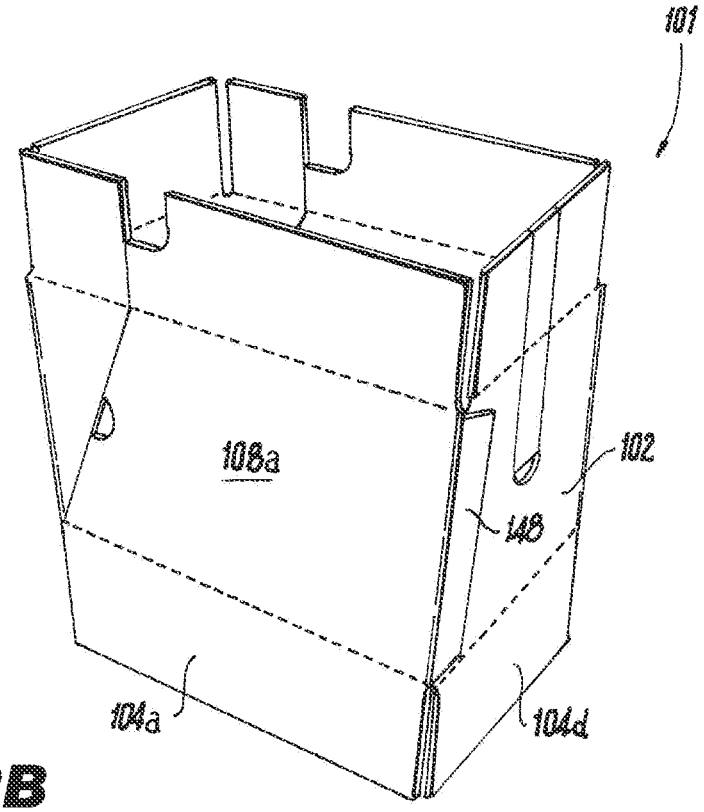
FIG. 2B is a schematic perspective view of the blank of FIG. 1, showing stages of erecting the blank into a container.
Figure 3A:
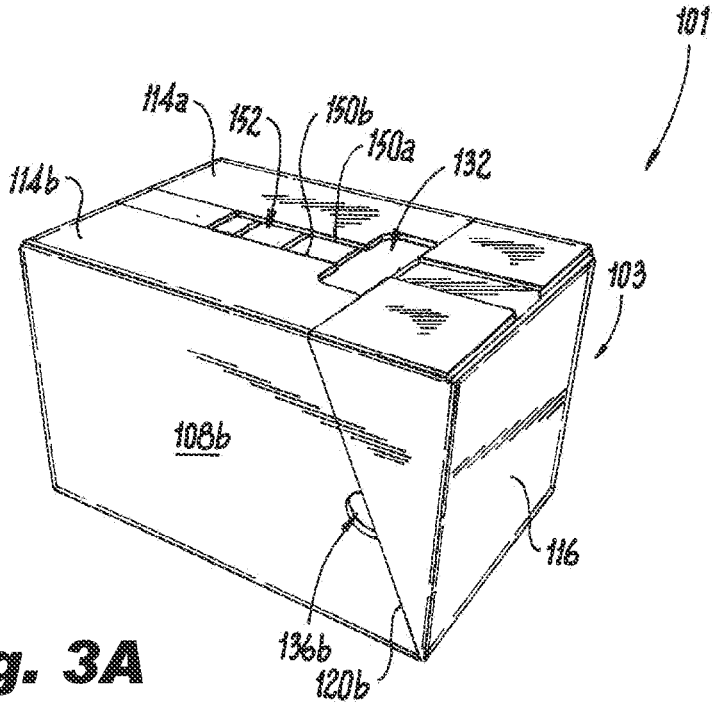
FIG. 3A is a schematic perspective view of the rear and top of container of FIGS. 2A-2B, showing the erected container with product inside.
Figure 3B:
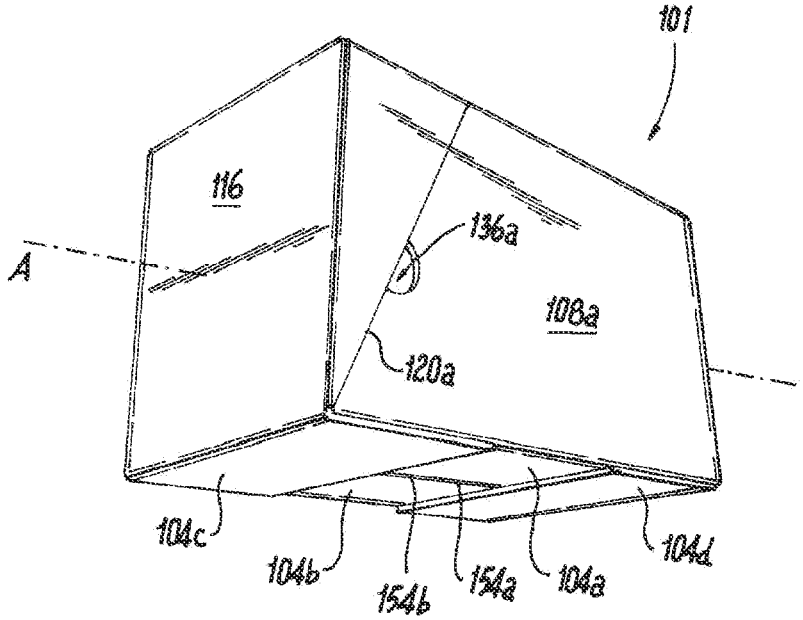
FIG. 3B is a schematic perspective view of the rear and bottom of container of FIGS. 2A-2B, showing the erected container with product inside.
Figure 4:
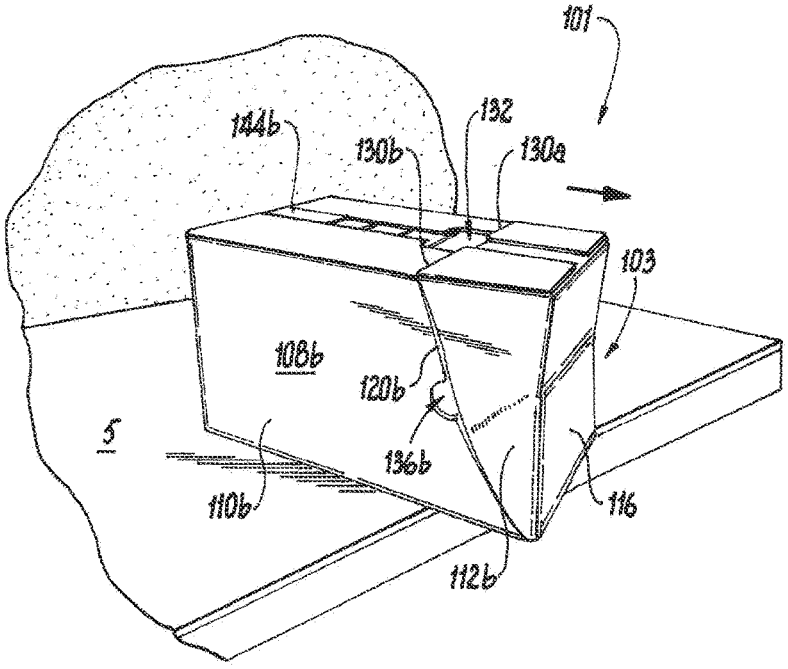
Figure 5:
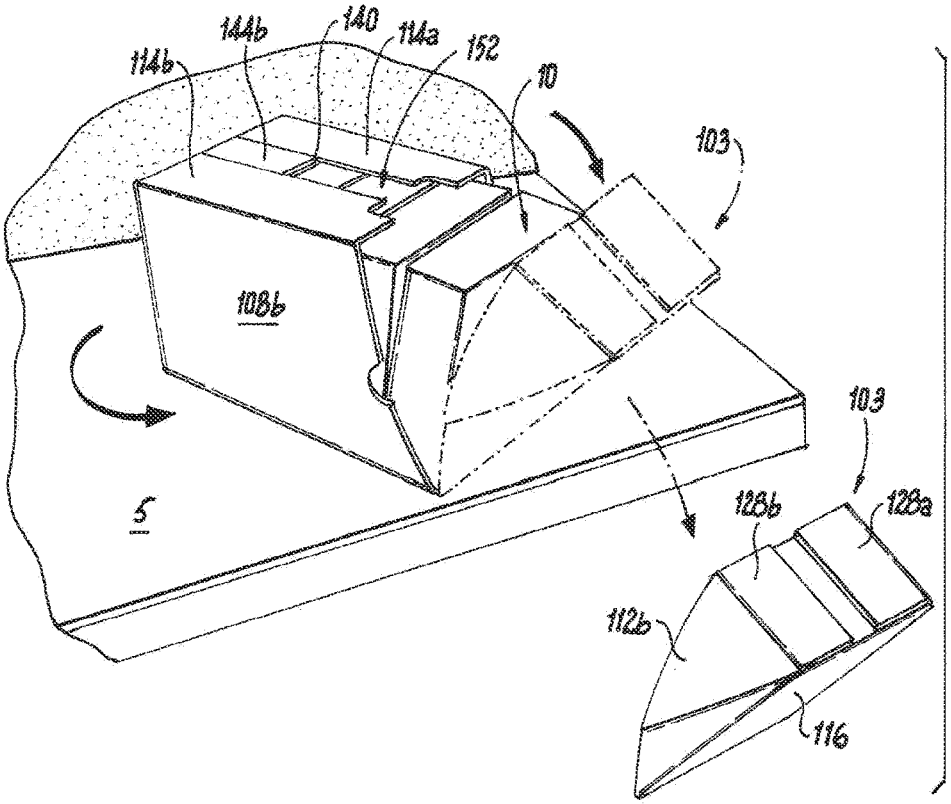
Figure 53:
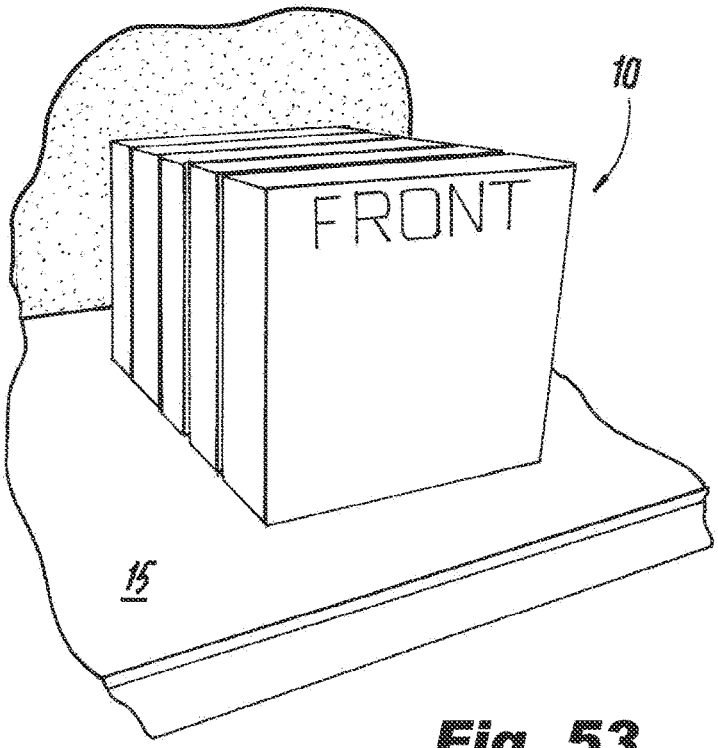

Reference will now be made to the drawings wherein like reference numerals identify similar structural features or aspects of the subject disclosure. For purposes of explanation and illustration, and not limitation, a partial view of an embodiment of a blank for forming a retail ready container in accordance with the disclosure is shown in FIG. 1, and is designated generally by reference character 100. Other embodiments of blanks and/or containers in accordance with the disclosure, or aspects thereof, are provided in FIGS. 2A-53, as will be described. The devices, systems and methods described herein can be used to provide retail ready containers that permit quick and efficient de-casing of product in order to re-stock shelves. Embodiments of the containers disclosed herein reduce time spent re-stocking without needing to leave the tray or case on the shelf.

As shown in FIG. 1, a blank 100 for constructing a retail ready container 101 includes a front panel 102 and a pair of side panels 108*a* and 108*b*. Side panel 108*a* includes a front portion 110*a* and a rear portion 112*a*. Side panel 108*b* includes a front portion 110*b* and a rear portion 112*b*. Side panel 108*b* is foldably connected to front panel 102 about a vertically oriented fold line 124. Blank 100 includes a rear panel 116 foldably connected between the rear portions 112*a* and 112*b* of the side panels 108*a* and 108*b* along respective rear vertical fold lines 118*a* and 118*b*. Blank 100 includes a plurality of bottom panels, e.g. flaps 104*a*-104*d*, a front bottom flap 104*d* is foldably connected to the front panel 102 along a lower front horizontal fold line 106*d*. Bottom flaps 104*a* and 104*b* are foldably connected to the side panels 108*a* and 108*b*, respectively, about respective horizontal fold lines 106*a* and 106*b*. The rear panel 116 is foldably connected to the rear bottom flap 104*c* along a separation line 122. Separation line, as used relative to all the figures and embodiments described herein, can include cuts, nicks, weakened portions, perforations, or the like. The side panel 108*a* includes a glue flap 148 extending from and foldably connected to the front portion 110*a* of the side panel 108*a* at a fold line 149.

With continued reference to FIG. 1, the blank 100 includes a plurality of top panels, e.g. flaps 114*a*-114*d*. Side top flaps 114*a* and 114*b* are foldably connected to side panels 108*a* and 108*b*, respectively, along upper horizontal fold lines 138*a* and 138*b*. Side top flap 114*a* includes a front portion 126*a* and a rear portion 128*a*, and side top flap 114*b* includes a front portion 126*b* and a rear portion 128*b*. The front portion 126*a* and rear portion 128*a* of side top flap 114*a* are separable from one another along a separation line 130*a*, e.g. a cut line. The front portion 126*b* and rear portion 128*b* of side top flap 114*b* are separable from one another along a separation line 130*b*, e.g. a cut line. The front portion

110*a* and rear portion 112*a* of side panel 108*a* are separable from one another along a separation line 120*a*.

With continued reference to FIG. 1, separation line 120*a* extends across side panel 108*a* from a corner defined by the intersection of fold line 118*a* and fold line 106*a* to a point along upper horizontal fold line 138*a*. The point along upper horizontal fold line 138*a* at which separation line 120*a* intersects is closer to fold line 118*a* than to fold line 149 on the opposite side of panel 108*a*. Separation line 120*b* extends across side panel 108*b* from a corner defined by the intersection of fold line 118*b* and fold line 106*b* to a point along upper horizontal fold line 138*b*. The point along upper horizontal fold line 138*b* at which separation line 120*b* intersects is closer to fold line 118*b* than to fold line 124 on the opposite side of panel 108*b*. Therefore, removable portion 103 is smaller than the remainder of the container 101, meaning that container 101 provides structural support even while incorporating separation lines 120*a* and 120*b*. The front portion 110*b* and rear portion 112*b* of side panel 108*b* are separable from one another along a separation line 120*b*. Separation line 120*b* extends from a corner defined by the intersection of fold line 118*b* and fold line 106*b*. The front portions 110*a* and 110*b* and rear portions 112*a* and 112*b* of respective side panels 108*a* and 108*b* are configured and adapted to be separated from one another along respective separation lines 120*a* and 120*b* such that the rear portions 112*a* and 112*b* of each side panel 108*a* and 108*b* and the rear panel 116 are configured and adapted for removal to provide access to the interior space 13 and the product 10.

With reference now to FIGS. 1-3B, each side panel 108*a* and 108*b* of the blank 100 includes a finger hole 136*a* and 136*b*, respectively. Finger hole 136*a* is defined by a semi-circular cut that that abuts separation line 120*a* between the front portion 110*a* and the rear portion 112*a*. The front portion 126*a* and rear portion 128*a* of side top flap 114*a* connect to front portion 110*a* and rear portion 112*a* of side panel 108*a*, respectively, along fold line 138*a*. The front portion 126*b* and rear portion 128*b* of side top flap 114*b* connect to front portion 110*b* and rear portion 112*b* of side panel 108*b*, respectively, along fold line 138*b*. Separation lines 130*a*, 120*a*, 122, 120*b* and 130*b* sequentially abut with one another and define a removable portion 103 of the container 101. The removable portion 103 includes rear portions 112*a* and 112*b* of the side panels 108*a* and 108*b*, the rear portions 128*a* and 128*b* of the side top flaps 114*a* and 114*b*, the rear panel 116 and the rear top flap 114*c*.

As shown in FIGS. 1-7, blank 100 is folded into a container 101 by folding side panel 108*a* about fold line 118*a* and folding front panel 102 about fold line 124, as indicated schematically by the arrows in FIG. 1. Glue is applied to glue flap 148 and glue flap 148 can be adhered to an interior surface 102*a* or outside surface of front panel 102, depending on which side of glue flap 148 has glue applied thereon. Once glued, the container 101 is erected as shown in FIGS. 2A-2B. Products 10 are loaded into container 101 such that a front side 11 of each product 10 faces front panel 102. A first set of bottom flaps 104*a* and 104*b* are folded about respective fold lines 106*a* and 106*b*, and then a second set of bottom flaps 104*c* and 104*d* are folded. Glue is applied between the first and second sets of bottom flaps to adhere bottom flaps 104*c* and 104*d* to one or both of bottom flaps 104*a* and 104*b* to enclose one end of the container 101. Each flap 104*a* and 104*b* of the first set of bottom flaps defines a terminal edge 154*a* and 154*b*. Terminal edges 154*a* and 154*b* are shown abutting in FIG. 3B. In some embodiments, however, there could be a space between terminal edges 154*a* and 154*b*. The terminal edges 154*a* and 154*b* for the set of flaps that are folded first (e.g. the ones that are in direct contact with products 10—in this case, flaps 104*a* and 104*b*) are each parallel to the product exit axis A such that when products 10 are removed from container 101 they do not get caught on an edge of one of the bottom flaps 104*a*, 104*b*, 104*c* or 104*d*. In the embodiment of FIGS. 1-7, this means that terminal edges 154*a* and 154*b* are parallel to product exit axis A.

With continued reference to FIGS. 1 and 4-7, top flaps 114*a* and 114*b* define terminal edges 150*a* and 150*b*. When blank 100 is folded into container 101, a finger slot 152 is defined between the terminal edges 150*a* and 150*b* of the first 114*a* and second 114*b* top flaps. Parallel separation lines 134 are defined in the front panel 102 and extend into front top flap 114*d*. The separation lines 134 extend from a terminal end 140 of the front top flap 114*d* inward to the front panel 102, ending at a finger hole 142 defined in the front panel 102. Top flap 114*c* is foldably connected to rear panel 116 along a fold line 138*c*. A removable portion 144, e.g. a removable strip, is defined between the two parallel separation lines 134. Removable strip 144 includes a portion 144*b* on top flap 114*d*. A portion of a handle hole 132 is defined in each top flap 114*a* and 114*b* by respective cut outs 146*a* and 146*b*.

As shown in FIGS. 4-7, once products 10 are loaded into container 101, the container 101 is closed by way of top and bottom flaps, 114*a*-114*d* and 104*a*-104*d*, respectively. The container 101 is then shipped to its desired location. When a user is ready to load products 10 onto a shelf 5, the user engages finger holes 136*a* and 136*b* and pulls on rear portions 112*a* and 112*b* of the side panels 108*a* and 108*b* to sever separation lines 120*a* and 120*b*, which are shown at least partially severed in FIG. 4. Rear portion 112*b* of side panel 108*b* is shown slightly bowed outward in FIG. 4 to schematically indicate the force applied as line 120*b* is severed. The user grasps the edges of rear portion 128*a* of top flap 114*a*, top flap 114*c* and rear portion 128*b* of top flap 114*b* that abuts handle hole 132 by putting a portion of or their entire hand into handle hole 132. By pulling in the direction schematically shown in FIGS. 4-5, separation lines (e.g. separation lines 120*a*, 122, and 120*b*) are severed and removable portion 103 is torn away from the remainder 101' of container 101'. As shown schematically by the arrow in FIG. 5, container 101 is then turned around so that the front panel 102 is facing the user. Removable strip 144, including portion 144*b* on top flap 114*d*, is then removed, for example, by way of a user's finger accessing removable strip 144 by way of the finger hole 142 and pulling removable strip 144, thereby extending finger slot 152.

As shown in FIG. 7, once removable portion 103 is off, a user pulls the remainder 101' of container 101 (e.g. the front portions of top panels 114*a* and 114*b*, the front portions of side panels 108*a* and 108*b*, bottom flaps 104*a*-104*d*, front panel 102 and glue flap 148) at finger slot 152, while applying an opposing force to products 10 so that they remains on shelf 5. Finger slot 152 allows for a user to access the interior of the container 101 from a front and top side to apply a force to the products 10 of the container 101 while sliding off the remainder 101' of container 101 that is left after removable portion 103 of container 101 is broken away, as shown in FIG. 7. This allows a user to stock a shelf 5, in particular lower shelves for example, with products 10 in an efficient manner without leaving a tray underneath the products 10, and without the user having to position themselves below the box.

A method of forming a container, e.g. container 101, from a blank, e.g. blank 100, includes folding a plurality of panels, e.g. front panel 102, rear panel 116 and side panels 108*a* and 108*b*, of the blank around an area to be enclosed by the container. The folding occurs at respective fold lines, e.g. fold lines 118*a*, 118*b* and 124, between the panels to form an erected blank defining a product exit axis A. The method includes folding a first set of bottom flaps, e.g. bottom flaps 104*a* and 104*b* attached to a bottom end of the erected blank 100 and folding a second set of bottom flaps, e.g. bottom flaps 104*c* and 104*d*, attached to the bottom end of the erected blank to enclose one end of the container. Each flap of the first set of bottom flaps defines a terminal edge, e.g. terminal edges 154*a* and 154*b*. Terminal edges are shown abutting in FIG. 3B. In some embodiments, however, there could be a space between terminal edges 154*a* and 154*b*. Each terminal edge of the first set of bottom flaps is parallel to the product exit axis A such that when products 10 are removed from container 101 it does not get caught on an edge of one of the bottom flaps.

In the embodiment of FIGS. 23-25, remainder 101' is left on a shelf 5. Container 101 in FIGS. 23-25 is the same as container 101, except that instead of loading products 10 to have a front facing surface 11 face front panel 102, products 10 are loaded such that front surface 11 faces rear panel 116. In this way, product 10 is ready for display after removable portion 103 and removable strip 144 are removed. Removable strip 144 can be removed as shown in FIG. 6, or it is contemplated that removable strip 144 can be removed while rear panel 116 is still facing at least partially outward on the shelf. The embodiment of FIGS. 23-25 negates the need to turn the remainder 101' of container 101 around and slide off the remainder 101'. Instead, in the embodiment of FIGS. 23-25, the remainder 101' is left on shelf 5 and product 10 is facing the outward direction ready for display. In this embodiment, finger slot 152 allows for a user to access the interior of the container 101 from a top side (e.g. proximate top flaps 114*a*, 114*b* and 114*d*) or front side (proximate front panel 102) to pull product/contents 10 out of remainder 101' of container 101.

Figure 21:
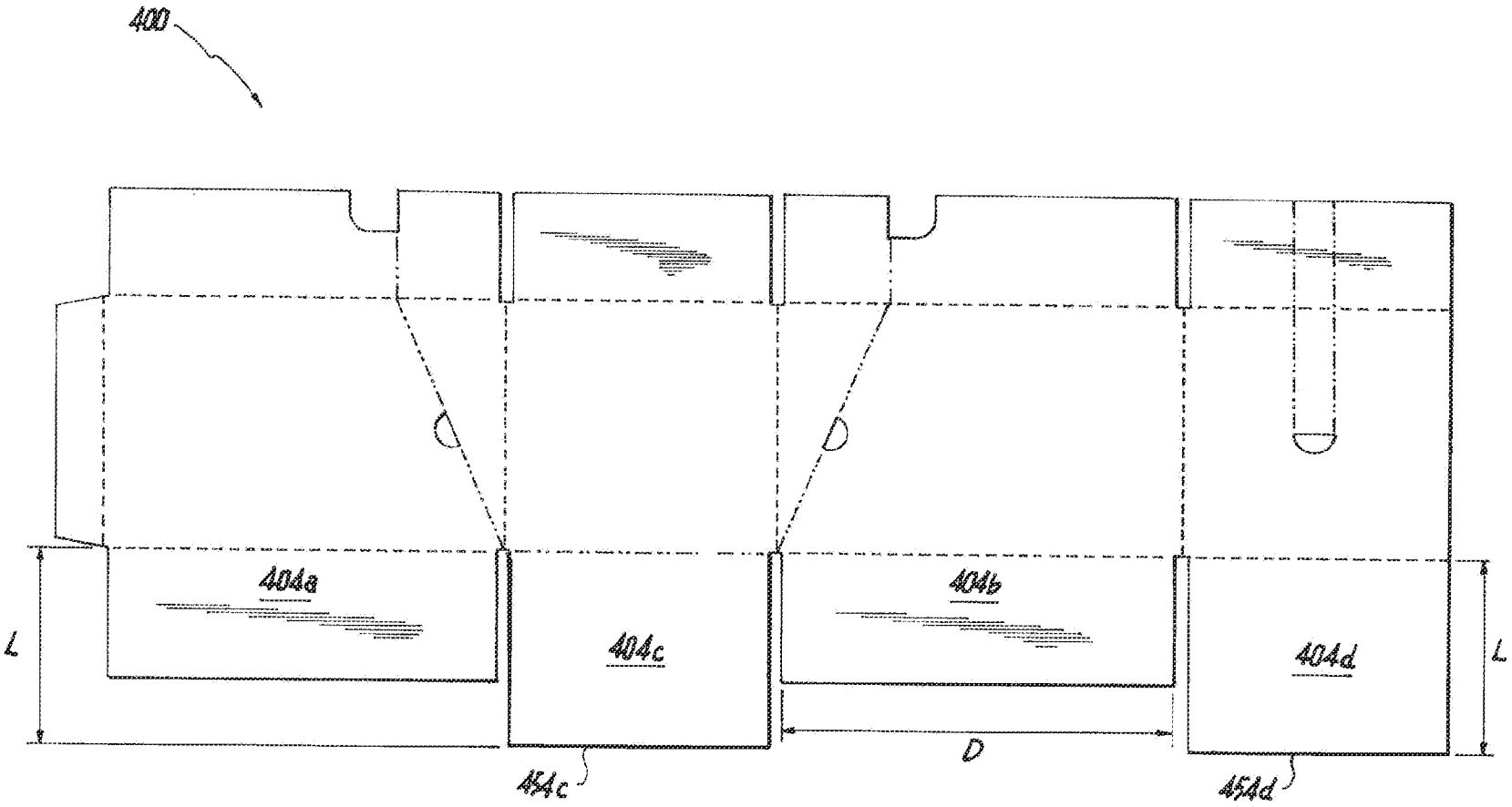
FIG. 21 is a schematic plan view of another embodiment of a blank constructed in accordance with the present disclosure, showing the interior surface of the blank with separation lines.
Figure 22:
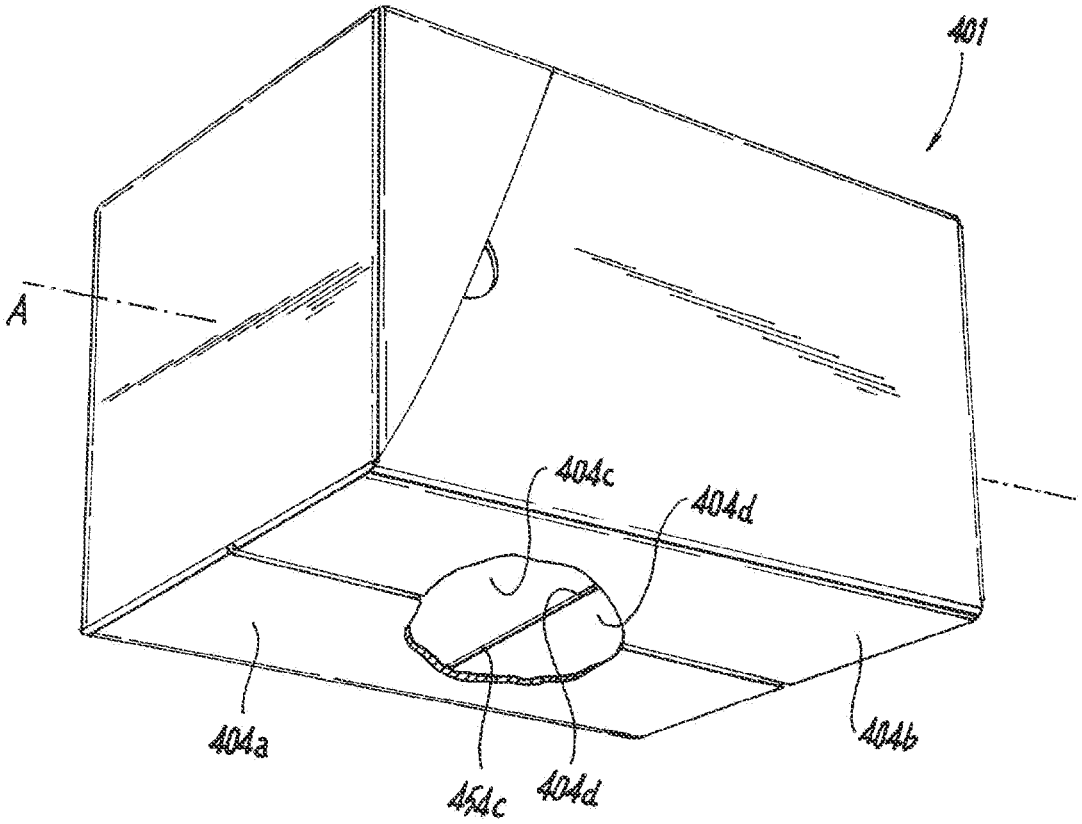
FIG. 22 is a schematic perspective view of the rear and bottom of a container formed by the blank of FIG. 21, showing the erected container with product inside.
Figure 26:
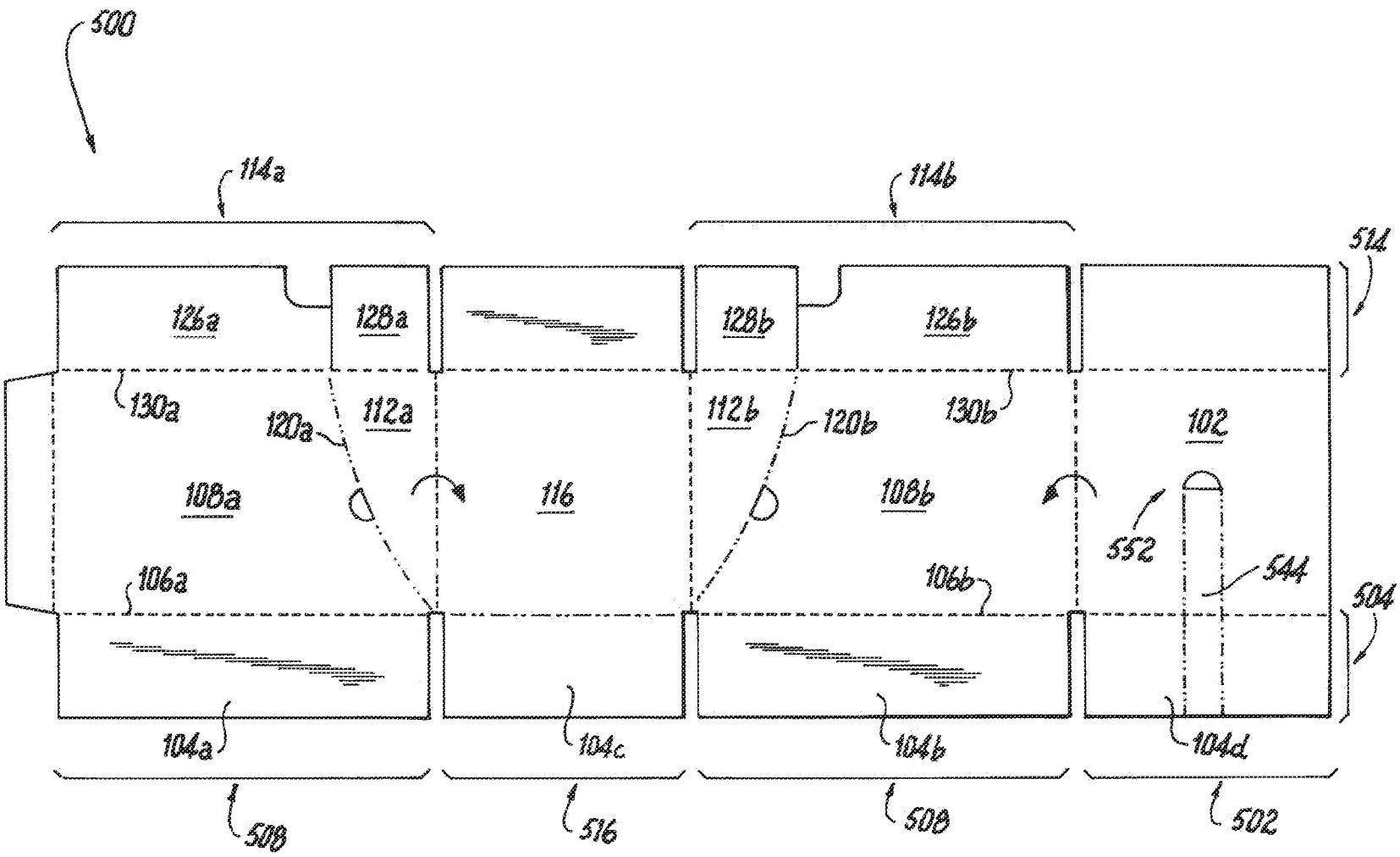
FIG. 26 is a schematic plan view of an embodiment of a blank constructed in accordance with the present disclosure, showing the interior surface of the blank with separation lines.

Alternatively, as shown in FIGS. 21-22, a blank 400 has bottom flaps 404*a*-404*d*, where bottom flaps 404*c* and 404*d* are longer such that there is no gap between a terminal edge 454*c* of bottom flap 404*c* and terminal edge 454*d* of bottom flap 404*d*. Each bottom flap 404*c* and 404*d* has a length L. Lengths L combined are equivalent to dimension D of the bottom flap 404*b*. In this way, the "minor" bottom flaps 404*c* and 404*d* are folded first, while the "major" bottom flaps 404*a* and 404*b* are folded second. Even though the terminal edges 454*c* and 454*d* are perpendicular to the product exit axis A when folded, the product is less likely to get caught because edges 454*c* and 454*c* abut one another, thereby still providing a smooth planar surface on which products 10 slide. Except for the change in lengths for bottom flaps 404*c* and 404*d*, blank 400 is the same as blank 100. Container 401 is the same as container 101, except that the bottom flaps 404*a*-404*d* are folded in a different order, as described above and as evident in FIG. 22.

Figure 8:
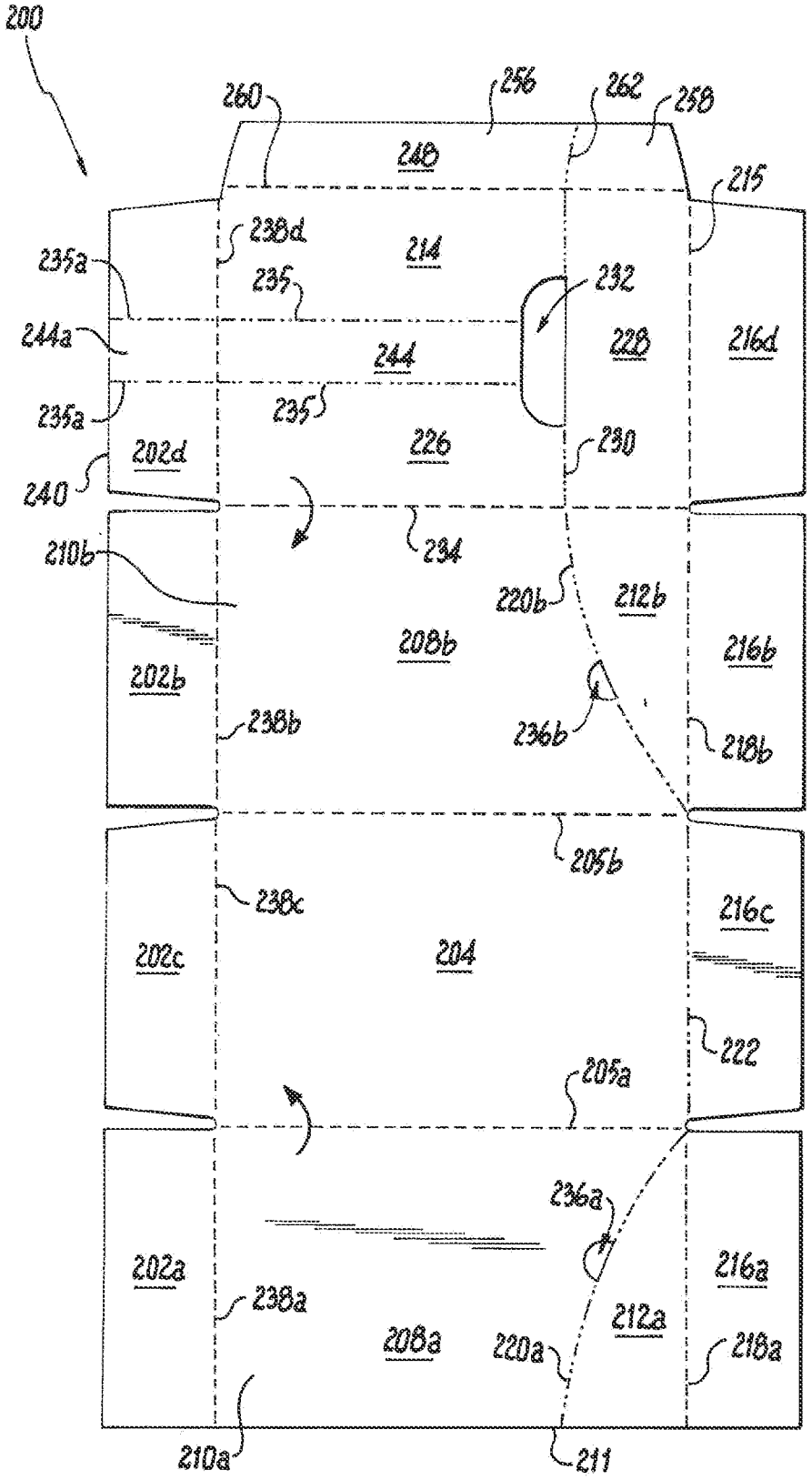
FIG. 8 is a schematic plan view of another embodiment of a blank constructed in accordance with the present disclosure, showing the interior surface of the blank with separation lines.

As shown in FIG. 8, a blank 200 for constructing a retail ready container 201 includes a bottom panel 204 foldably connected to a pair of opposed side panels 208*a* and 208*b*. Side panel 208*a* includes a front portion 210*a* and a rear portion 212*a* and is foldably connected to bottom panel 204 at fold line 205*a*. Side panel 208*b* includes a front portion 210*b* and a rear portion 212*b* and is foldably connected to bottom panel 204 at fold line 205*b*. Blank 200 includes front panels, also referred to herein as front flaps 202*a*-202*d*. Front flaps 208*a* and 208*b* are connected to side panels 208*a* and 208*b*, respectively, about respective fold lines 238*a* and 238*b*. Bottom panel 204 is foldably connected to the front flap 208*c* along a lower front horizontal fold line 238*c*. Blank 200 includes a top panel 214 foldably connected to side panel 208*b* about a fold line 234. Front flap 202*d* is foldably connected to top panel 214 at a fold line 238*d*. Blank 200 includes a glue flap 248 that extends from and is foldably connected to the top panel 214. Glue flap 248 includes a front portion 256 and rear portion 258. The front portion 226 and rear portion 228 of top panel 214 connect to front portion 256 and rear portion 258 of glue flap 248, respectively, along a fold line 260. Front and rear portions 256 and 258 of glue flap are separable from one another along a separation line 262.

With continued reference to FIG. 8, the blank 200 includes a plurality of rear panels, also referred to herein as rear flaps 216*a*-216*d*. Rear flaps 216*a* and 216*b* are foldably connected to respective side panels 208*a* and 208*b* at respective vertically oriented fold lines 218*a* and 218*b*. The front portion 210*a* and a rear portion 212*a* of the side panel 208*a* are separable from one another along a separation line 220*a*, and the front portion 210*b* and a rear portion 212*b* of the side panel 208*b* are separable from one another along a separation line 220*b*, such that the rear portions 212*a* and 212*b* of the side panels 208*a* and 208*b*, and the rear flaps/panel 216*a*-216*d* are configured and adapted for removal. Separation line 220*a* extends across side panel 208*a* from a corner defined by the intersection of fold line 218*a* and fold line 205*a* to a point along an upper terminal edge 211 of side panel 208*a*. The point along upper terminal edge 211 at which separation line 220*a* intersects is closer to fold line 218*a* than to fold line 238*a* on the opposite side of panel 208*a*. Separation line 220*b* extends across side panel 208*b* from a corner defined by the intersection of fold line 218*b* and fold line 205*b* to a point along fold line 234. The point along upper horizontal fold line 234 at which separation line 220*b* intersects is closer to fold line 218*b* than to fold line 238*b* on the opposite side of panel 208*b*. Therefore, removable portion 203 is smaller than the remainder of the container 201, meaning that container 201 provides structural support even while incorporating separation lines 220*a* and 220*b*. The rear flap 216*c* is foldably connected to the bottom panel 204 along a separation line 222. The rear flap 216*d* is foldably connected to the top panel 214 along a fold line 215.

With reference now to FIGS. 8-10B, each side panel 208*a* and 208*b* of the blank 200 includes a finger hole 236*a* and 236*b*, respectively. Finger hole 236*a* is defined by a semi-circular cut that that abuts separation line 220*a*, between the front portion 210*a* and the rear portion 212*a* of side panel 208*a*. Finger hole 236*b* is defined by a semi-circular cut that that abuts separation line 220*b*, between the front portion 210*b* and the rear portion 212*b* of side panel 208*b*. Top panel 214 includes a front portion 226 and a rear portion 228. Front and rear portions 226 and 228 are separably connected to one another along a separation line 230. The front portion 226 and rear portion 228 of top flap 214 panel connect to front portion 210*b* and rear portion 212*b* of side panel 208*b*, respectively, along fold line 234. Separation lines 262, 230, 220*b*, 222, and 220*a* sequentially abut with one another and define a removable portion 203 of the blank 200. The removable portion 203 includes rear portions 212*a* and 212*b* of the side panels 208*a* and 208*b*, the rear portion 228 of the top panel 214, the rear flaps 216*a*-216*d*, and the rear portion 258 of the glue flap 248.

As shown in FIGS. 8-14, blank 200 is folded into container 201 by folding side panel 208*a* about a fold line 205*a* toward bottom panel 204 and folding top panel 214 about a fold line 234 towards side panel 208*b*. The glue flap 248 is adhered to an outside surface of the side panel 208*a*. Those skilled in the art will readily appreciate that an outer surface of glue flap 248 can be adhered to an inner surface of side panel 208*a*. Blank 200 is erected by further folding bottom panel 204 about fold line 205*b* and folding glue flap 248 about fold line 260. Specifically, front portion 256 and rear portion 258 of glue flap 248 are adhered to front portion 210*a* and rear portion 212*a* of side panel 208*a*, respectively. Glue is applied between outer surface of rear flap 216*a* and inner surfaces of rear flaps 216*c* and 216*d*, and glue is applied between outer surface of rear flap 216*b* and inner surfaces of rear flaps 216*c* and 216*d* to enclose the rear side of the container 201. Glue is applied between outer surface of front flap 202*a* and inner surfaces of front flaps 202*c* and 202*d*, and glue is applied between outer surface of front flap 202*b* and inner surfaces of front flaps 202*c* and 202*d* to enclose the front side of the container 201. Those skilled in the art will readily appreciate that product, e.g. product 10, can be added before or after gluing and erecting the panels of the blank, between gluing the two sides, or any other suitable time. Products 10 are loaded into container 201 such that a front side 11 of each product 10 faces front flaps 202*a*-202*d*, which facilitates decasing and display, as described in more detail below.

Figure 10A:
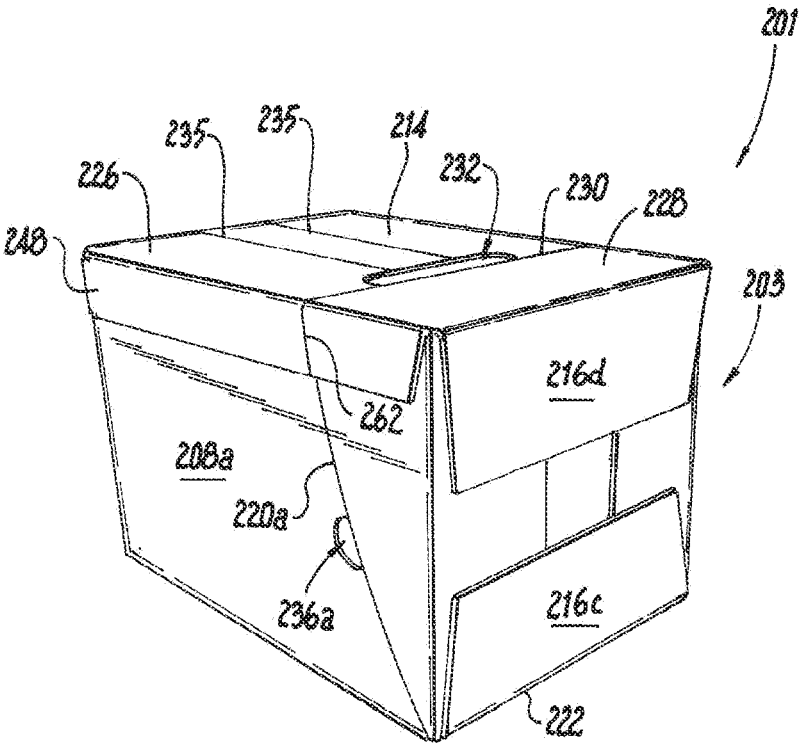
FIG. 10A is a schematic perspective view of the rear and top of container of FIGS. 9A-9B, showing the erected container with product inside.
Figure 10B:
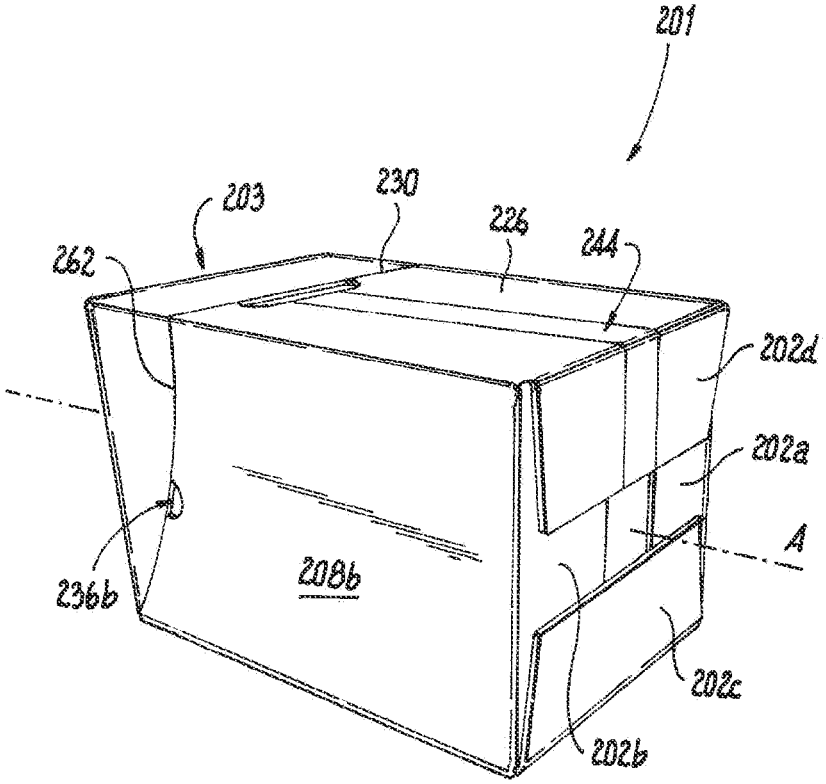
FIG. 10B is a schematic perspective view of the front side of the container of FIGS. 9A-9B, showing the erected container with product inside.

With reference now to FIGS. 10A-10B, front portion 226 of the top panel 214 includes a removable portion 244, e.g. a removable strip, defined between the two parallel separation lines 235. Portions of separation lines 235 and removable strip 244 extend onto front flap 202*d* and are identified as separation lines 235*a* and removable strip 244*a*. A handle hole 232 is defined in top panel 214 along an edge of separation line 230. The two parallel separation lines 235 extend from handle hole 232 along top panel 214 to a terminal end 240 of front flap 202*d*.

As shown in FIGS. 11-14, once products 10 are loaded into container 201 and closed, it is shipped to its desired location. When a user is ready to load products 10 onto a shelf 5, removable strip 244, including portion 244*a* on top flap 202*d*, is removed, for example, by way of a user's finger accessing removable strip 244 at handle hole 232 or at end 240 of front flap 202*d*, and pulling removable strip 244, thereby creating finger slot 252 between the edges 250*a* and 250*b* of top panel 214. Removal of strip 244 and removal direction is shown schematically in FIG. 11. As shown in FIGS. 11-12, once removable strip 244 is off, a user turns the container 201 around such that they can access a rear side of container 201. The user engages finger holes 236*a* and 236*b* and pulls on rear portions 212*a* and 212*b* of the side panels 208*a* and 208*b* to sever separation lines 220*a* and 220*b*, which are shown at least partially severed in FIG. 12. Rear portion 212*a* of side panel 208*a* is shown slightly bowed outward in FIG. 12 to schematically indicate the force applied as line 220*a* is severed. The removable portion 203 is removed by the user pulling on rear portion 228 of top flap 214 by way of putting a portion of or their entire hand into handle hole 232. By pulling in the direction schematically shown by the arrow in FIGS. 12-13, separation lines (e.g. separation lines 230, 220*a*, 222 and 220*b*) are severed and removable portion 203 is torn away from a remainder 201' of container 201.

Figure 13:
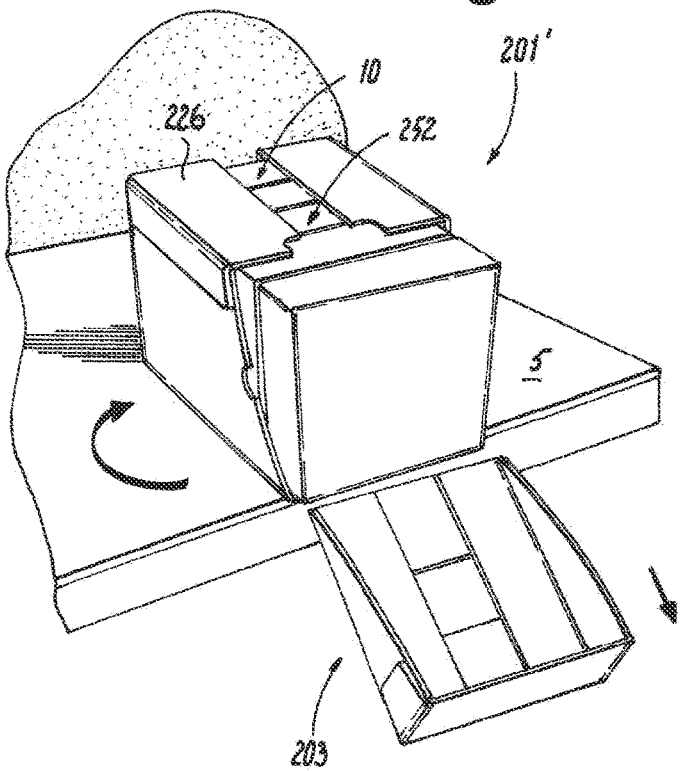
Figure 14:
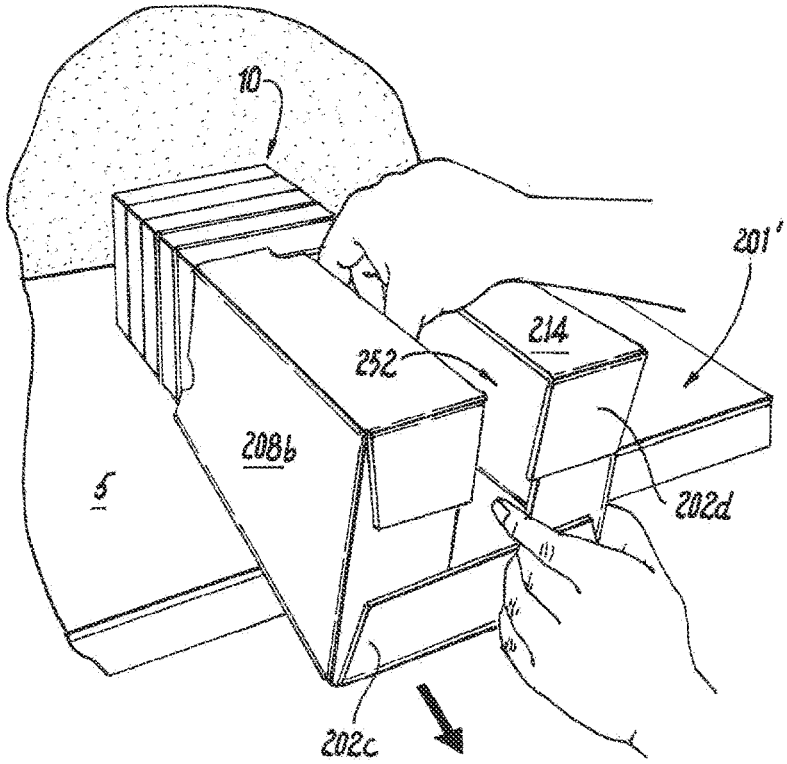

With reference now to FIGS. 13-14, the remainder 201' of container 201 is turned around so that the front panels 202*a*-202*d* are facing the user, as shown schematically by the arrow in FIG. 13. The user can pull the remainder 201' of container 201 (e.g. the front portions of top panel 214, the front portions of side panels 208*a* and 208*b*, bottom panel 204, front flaps 202*a*-202*d* 102 and the front portion of glue flap 248) at finger slot 252 (which now extends into the opening between front flap 202*d* and front flap 202*c*), while applying an opposing force to products 10 so that they remains on shelf 5. Finger slot 252 allows for a user to access the interior of the container 201 from a front and top side to apply a force to the products 10 in container 201 while sliding off the remainder 201' of container 201, as shown in FIG. 14. This allows a user to stock a shelf with product facing in the correct forward direction in an efficient manner without leaving a tray underneath the product.

In accordance with some embodiments, similar to the loading and decasing of FIGS. 23-25, instead of loading products 10 into container 201 to have a front facing surface 11 face front panels 202*a*-202*d*, products 10 are loaded into container 201 such that front surface 11 faces rear flaps 216*a*-216*d*. In this way, product 10 is ready for display after removable portion 203 and removable strip 244 are removed. This negates the need to turn the remainder 201' of container 201 around and slide off the remainder 201'. For example, instead of turning remainder 201' around as schematically shown by FIGS. 13-14, remainder 201' can remain on shelf 5 in the direction that it is shown in FIG. 13, and simply be pushed backward as needed, similar to container 101 shown in FIG. 25. In this embodiment, finger slot 252 allows for a user to access the interior of the container 201 from a top side (e.g. proximate top panel 214) and/or front side (proximate front flaps 202*a*-202*d*) to pull product/contents 10 out of remainder 201' of container 201.

Figure 15:
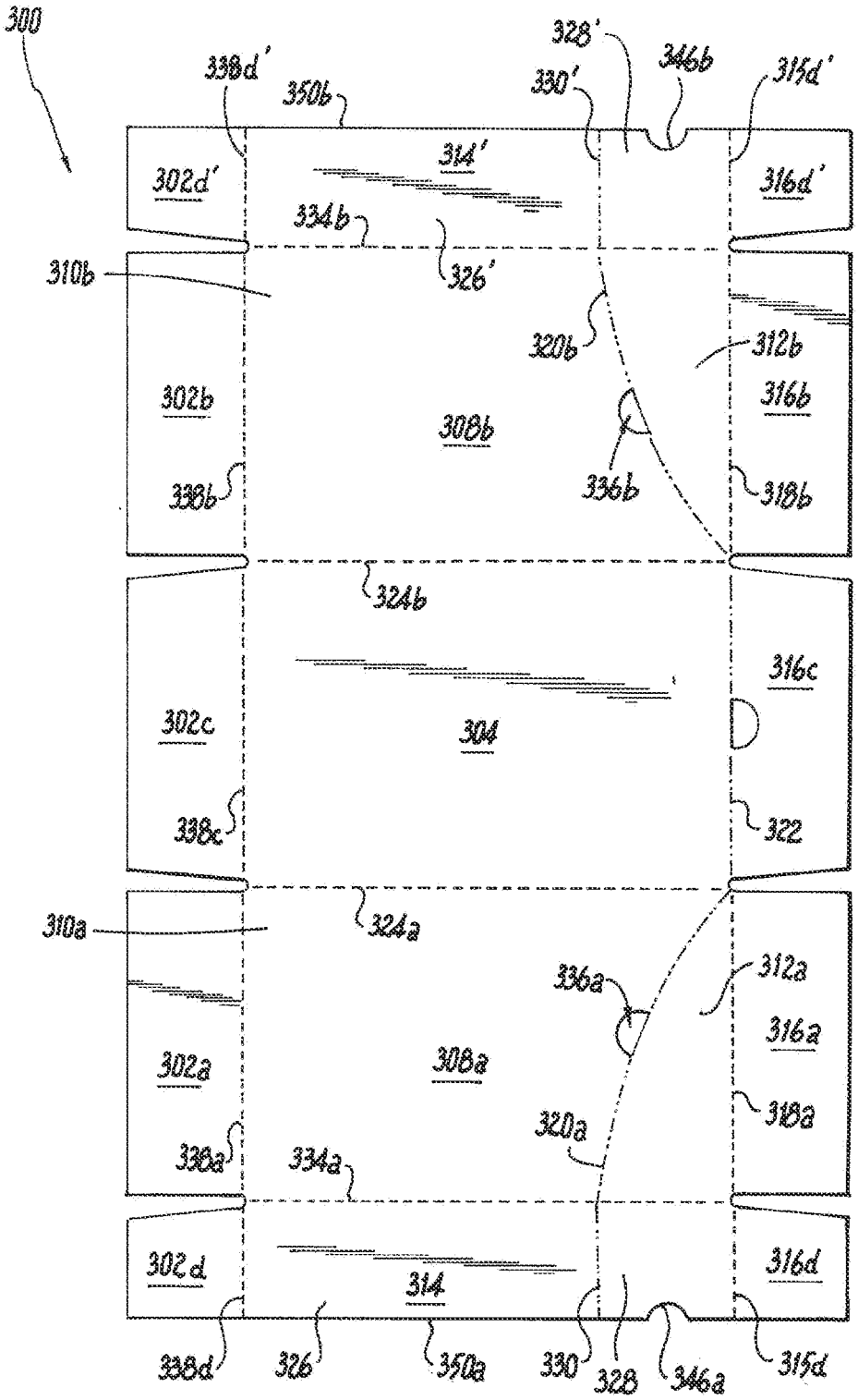
FIG. 15 is a schematic plan view of another embodiment of a blank constructed in accordance with the present disclosure, showing the interior surface of the blank with separation lines.

As shown in FIG. 15, a blank 300 for constructing a retail ready container 301 includes a bottom panel 304 foldably connected to a pair of opposed side panels 308*a* and 308*b*. Side panel 308*a* includes a front portion 310*a* and a rear portion 312*a*. Side panel 308*b* includes a front portion 310*b* and a rear portion 312*b*. Blank 300 includes a front panel comprised of front flaps 302*a*-302*d*'. Front flaps 308*a* and 308*b* are connected to side panels 308*a* and 308*b*, respectively, about respective fold lines 338*a* and 338*b*. Bottom panel 304 is foldably connected to the front flap 302*c* along a lower front horizontal fold line 338*c*. Blank 300 includes a pair of top panels 314 and 314' foldably connected to respective side panels 308*a* and 308*b* about respective fold lines 334*a* and 334*b*. Front flap 302*d* is foldably connected to top panel 314 at a fold line 338*d*. Front flap 302*d*' is foldably connected to top panel 314' at a fold line 338*d*'.

With continued reference to FIG. 15, the blank 300 includes rear panels, also referred to herein as rear flaps 316*a*-316*d*'. Rear flaps 316*a* and 316*b* are foldably connected to respective side panels 308*a* and 308*b* at respective vertically oriented fold lines 318*a* and 318*b*. The front portion 310*a* and a rear portion 312*a* of the side panel 308*a* are separable from one another along a separation line 320*a*, and the front portion 310*b* and a rear portion 312*b* of the side panel 308*b* are separable from one another along a separation line 320*b*, such that the rear portions 312*a* and 312*b* of the side panels 308*a* and 308*b*, and the rear flaps 316*a*-316*d*' are configured and adapted for removal to provide access to the interior space 13. The rear flap 316*c* is foldably connected to the bottom panel 304 along a separation line 322. The rear flap 316*d* is foldably connected to the top panel 314 along a fold line 315*d*. The rear flap 316*d*' is foldably connected to the top panel 314*d*' along a fold line 315*d*'. Separation line 320*a* extends across side panel 308*a* from a corner defined by the intersection of fold line 318*a* and fold line 324*a* to a point along fold line 334*a* of side panel 308*a*. The point along fold line 334*a* at which separation line 320*a* intersects is closer to fold line 318*a* than to fold line 338*a* on the opposite side of panel 308*a*. Separation line 320*b* extends across side panel 308*b* from a corner defined by the intersection of fold line 318*b* and fold line 324*b* to a point along fold line 334*b* of side panel 308*b*. The point along fold line 334*b* at which separation line 320*b* intersects is closer to fold line 318*b* than to fold line 338*b* on the opposite side of panel 308*b*. Therefore, removable portion 303 is smaller than the remainder of the container 301, meaning that container 301 provides structural support even while incorporating separation lines 320*a* and 320*b*.

As shown in FIGS. 15-18, each side panel 308*a* and 308*b* of the blank 300 includes a finger hole 336*a* and 336*b*, respectively. Finger hole 336*a* is defined by a semi-circular cut that that abuts separation line 320*a*, between the front portion 310*a* and the rear portion 312*a* of side panel 308*a*. Finger hole 336*b* is defined by a semi-circular cut that that abuts separation line 320*b*, between the front portion 310*b* and the rear portion 312*b* of side panel 308*b*. Top panel 314 includes a front portion 326 and a rear portion 328. Front and rear portions 326 and 328 are separably connected to one another along a separation line 330. The front portion 326 and rear portion 328 of top flap 314 are connect to front portion 310*a* and rear portion 312*a* of side panel 308*a*, respectively, along fold line 334*a*. Top panel 314' includes a front portion 326' and a rear portion 328'. Front and rear portions 326' and 328' are separably connected to one another along a separation line 330'. The front portion 326' and rear portion 328' of top flap 314' panel connect to front portion 310*b* and rear portion 312*b* of side panel 308*b*, respectively, along fold line 334*b*.

Figure 16:
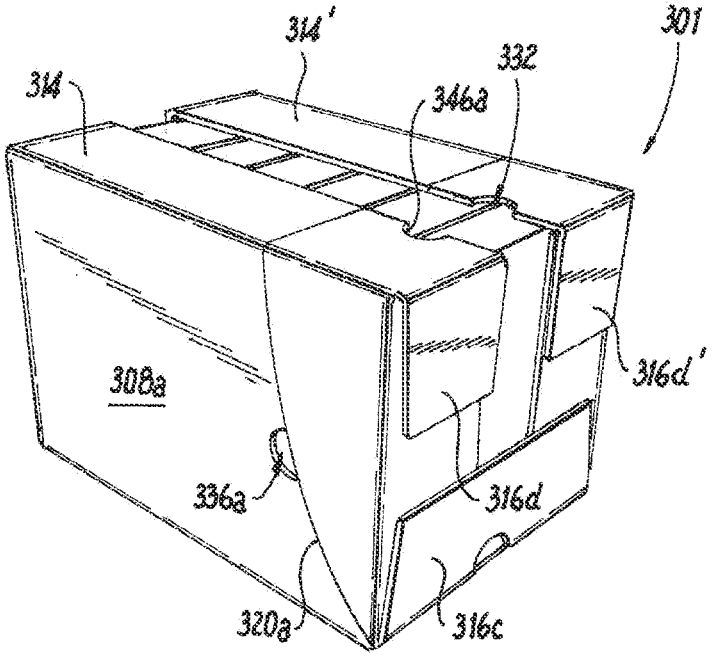
FIG. 16 is a schematic perspective view of the rear and top of a container formed with the blank of FIG. 15, showing the erected container with product inside.
Figure 17:
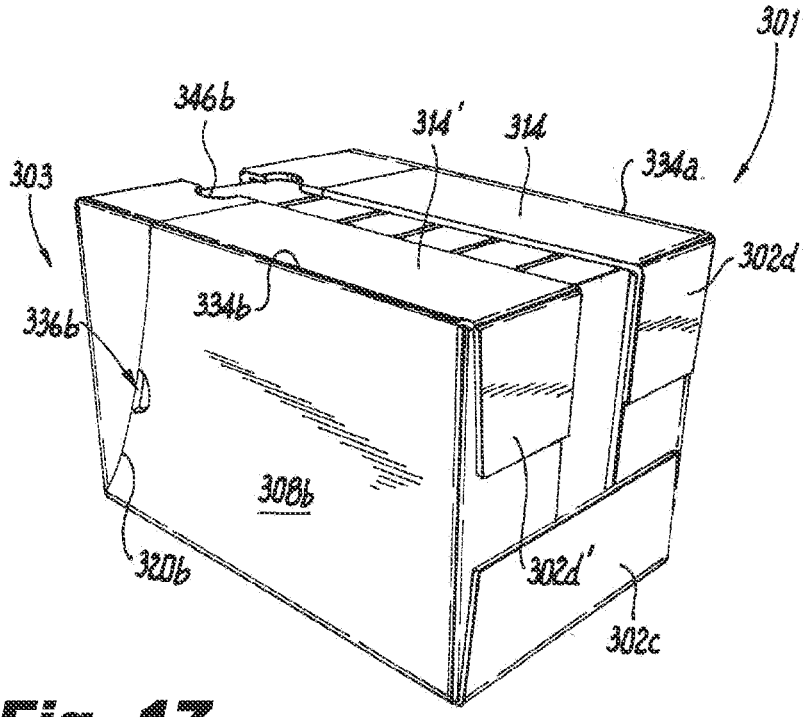
FIG. 17 is a schematic perspective view of the front side of the container formed with the blank of FIG. 15, showing the erected container with product inside.

As shown in FIGS. 15-17, separation lines 330, 320*a*, 322, 320*b* and 330' sequentially abut with one another and define a removable portion 303 of the blank 300. The removable portion 303 includes rear portions 312*a* and 312*b* of the side panels 308*a* and 308*b*, the rear portions 328 and 328' of the top flaps 314 and 314', and the rear flaps 316*a*-316*d'*. Top flaps 314 and 314' define terminal edges 350*a* and 350*b*. When blank 100 is folded into container 301 finger slot 352 is defined between the terminal edges 350*a* and 350*b* of top flaps 314 and 314'. At least a portion of a handle hole 332 is defined in each top flap 314 and 314' by respective cut outs 346*a* and 346*b*.

As shown in FIGS. 15-17, blank 300 is folded into container 301 by folding side panel 308*a* about a fold line 324*a* toward bottom panel 304 and folding side panel 308*b* about fold line 324*b* toward bottom panel 304. Blank is then folded further by folding top panel 314 about fold line 334*a* inwards toward side panel 308*a* and by folding top panel 314' about fold line 334*b* inwards toward side panel 308*b*. Rear flaps 316*a*-316*d'* are folded and glue is applied between outer surface of rear flap 316*b* and inner surfaces of rear flaps 316*c* and 316*d'*, and between outer surface of rear flap 316*a* and inner surfaces of rear flaps 316*c* and 316*d* to enclose the rear side of the container 301. Front flaps 302*a*-302*d'* are folded and glue is applied between outer surface of front flap 302*a* and inner surfaces of front flaps 302*c* and 302*d*, and glue is applied between outer surface of front flap 302*b* and inner surfaces of front flaps 302*c* and 302*d'* to enclose the front side of the container 301. Those skilled in the art will readily appreciate that product, e.g. product 10, can be added before or after gluing and erecting the panels of the blank, between gluing the two sides, or any other suitable time.

With reference now to FIGS. 16-20, once products 10 are loaded into container 301 and closed, it can be shipped to its desired location. Products 10 are loaded into container 301 such that a rear facing surface 12 of each product 10 faces rear flaps 316*a*-316*d'*. The user engages finger holes 336*a* and 336*b* and pulls on rear portions 312*a* and 312*b* of the side panels 308*a* and 308*b* to sever separation lines 320*a* and 320*b*, which are shown at least partially severed in FIG. 18. Rear portion 312*a* of side panel 308*a* is shown slightly bowed outward in FIG. 18 to schematically indicate the force applied as line 320*a* is severed. User uses handle hole 332 at cut outs 346*a* and 346*b* to grasp rear portions 328 and 328' of top panels 314 and 314', respectively, and pull a removable portion 303 off of container 301. By pulling in the directions schematically shown by the arrows in FIGS. 18-19, separation lines (e.g. separation lines 330, 320*a*, 322, 320*b* and 330') are severed and removable portion 303 is torn away from a remainder 301' of container 301.

Figure 18:
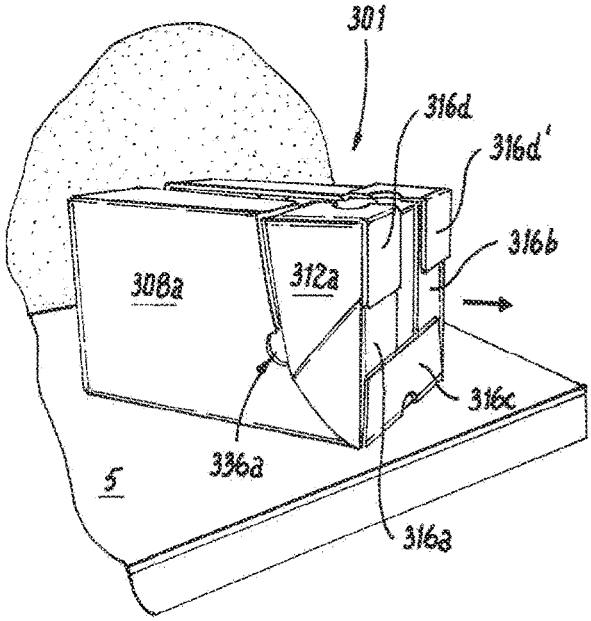
FIGS. 18-20 are schematic perspective views of the container of FIGS. 17A-17B, showing stages of using the container to facilitate retail display of the product.
Figure 19:
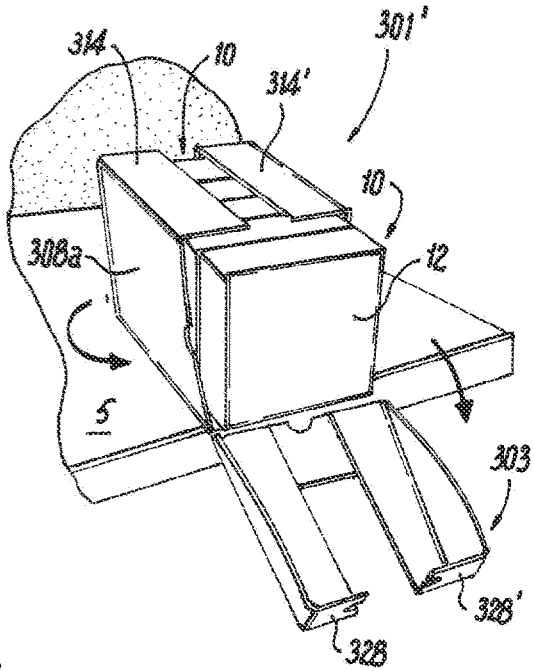
Figure 20:
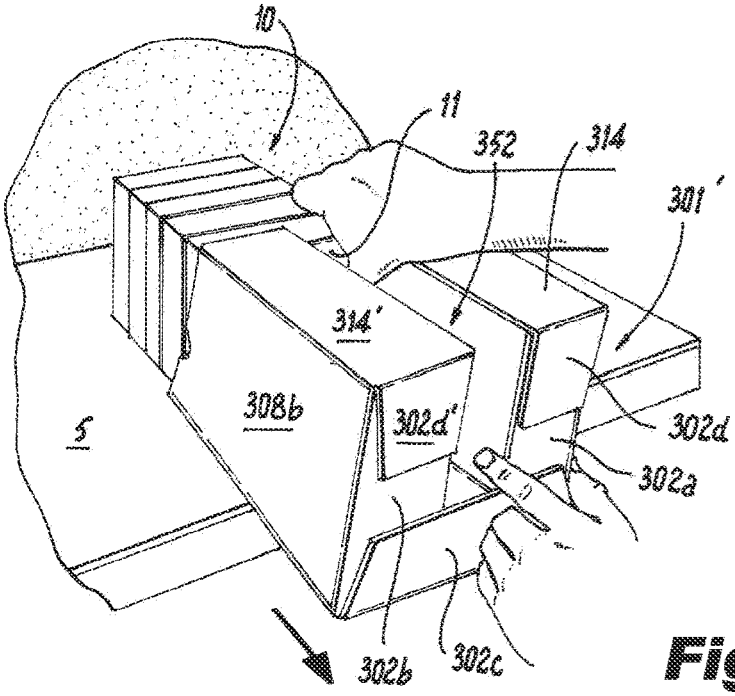

With reference now to FIGS. 18-20, the remainder 301' of container 301 is turned around so that the front panels 302*a*-302*d'* are facing the user, as shown schematically by the arrow in FIG. 19. The user can pull the remainder 301' of container 301 (e.g. the front portions of top panels 314 and 314', the front portions of side panels 308*a* and 308*b*, bottom panel 304, front flaps 302*a*-302*d'*) at finger slot 352 (which extends into the opening between the edges of front flaps 302*d* and 302' and between the edges of front flaps 302*a* and 302*b* front flap 302*c*), while applying an opposing force to product 10 so that it and other products 10 remain on shelf 5. Finger slot 352 allows for a user to access the interior of the container 301 from a front and top side to apply a force to the product/contents 10 of the container 301 while sliding off the remainder 301' of container 301, as shown in FIG. 20. This allows a user to stock a shelf with product in an efficient manner without leaving a tray underneath the product.

In accordance with some embodiments, similar to the loading and decasing of FIGS. 23-25, instead of loading products 10 into container 301 to have a front facing surface 11 face front panels 302*a*-302*d'*, products 10 are loaded into 301 such that front surface 11 faces rear flaps 316*a*-316*d'*. In this way, product 10 is ready for display after removable portion 303 is removed. This negates the need to turn the remainder 301' of container 301 around and slide off the remainder 301'. For example, instead of turning remainder 301' around as schematically shown by FIGS. 19-20, remainder 301' can remain on shelf 5 in the direction that it is shown in FIG. 19, and simply be pushed backward as needed, similar to container 101 shown in FIG. 25. In this embodiment, finger slot 352 allows for a user to access the interior of the container 301 from a top side (e.g. proximate top panels 314 and 314') and/or front side (proximate front panel 302*a*-302*d'*) to pull product/contents 10 out of remainder 301' of container 301.

In accordance with at least one aspect of this disclosure, as shown in FIGS. 26-36 for example, a blank 500 for constructing a container 501, can be similar to that of blank 100 for constructing container 101, for example blank 500 can have similar components and features, and may be erected in a similar manner to that described with respect to blank 100 and container 101. For brevity, the description of common elements that have been described above are not repeated with respect to FIGS. 26-36.

In blank 500, the rear panel 116 can form at least part of a rear wall 516 in the formed container 501, the top panel 114 can form at least part of a top wall 514 in the formed container 501, the front panel 102 can form at least part of a front wall 502 in the formed container 501, the bottom panel 104 can form at least part of a bottom wall 504 in the formed container 501, and the a side panel 108 can form at least part of a side wall 508 in the formed container 501.

As shown and described (e.g., in FIGS. 32 and 33), an entirety of the rear wall (e.g., all of rear panel 116, rear portions 112*a*, 112*b* of side panel 108, rear portions 128*a*, 128*b* of top panel 114) configured and adapted for removal. A finger slot 552 (e.g., formed by removing removable portion 544) can be defined in the formed container 501, extending through at least one of the front wall 502, the top wall 514 (e.g., as in container 101), the bottom wall 504, and/or the side wall 508 (e.g., as shown in phantom in FIG. 28A, opposite the glue flap 148) to allow a user to access an interior of the formed container 501.

In certain embodiments, the finger slot 552 can be defined between two separation lines 534 and, unlike blank 100, the finger slot 544 extends from a finger hole 542 towards the bottom panel 104*d*. The separation lines 120*a*, 120*b* between the front 108*a*, 108*b* and rear portions 112*a*, 112*b* of the side panel extends from the separation line 122 on the bottom panel 104 towards the top panel 114, opposite the removable portion 544. In embodiments, the front portion of the top panel 126*a*, 126*b* can be longer the rear portion 128*a*, 128*b* of the top panel 114, so that a length of the bottom flap 104*a*, 104*b* is greater than a length of the front portion 126*a*, 126*b* of the top panel 114. Accordingly, a length of the front portion of the side panel 108 proximate the bottom panel 104 (e.g., along fold lines 106*a*, 106*b*) is greater than a length of the front portion of the side panel 108 proximate the top panel 114 (e.g., along fold lines 138*a*, 138*b*). Having a bottom portion longer than the top portion allows the product 10 to remain upright after the removable portion 103 is removed from the container 501, and while the remaining portion 501' of the container 501 is pulled off of the product 10, as explained below.

Figure 29:
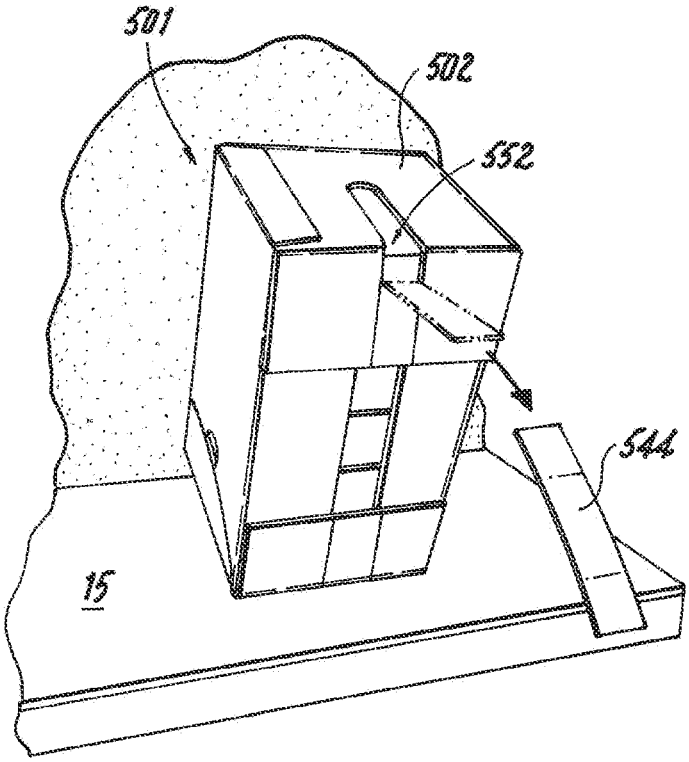
Figure 30:
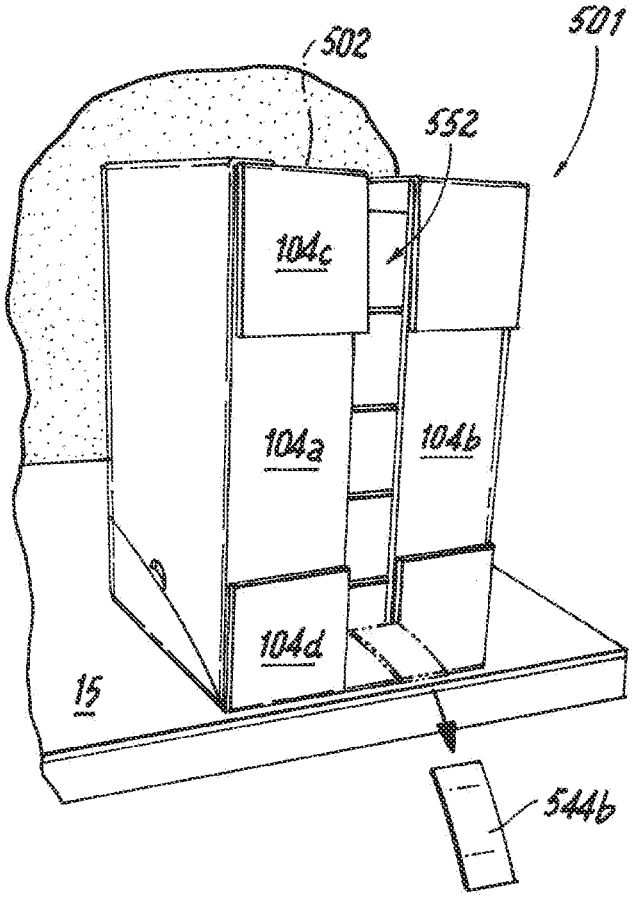
Figure 37:
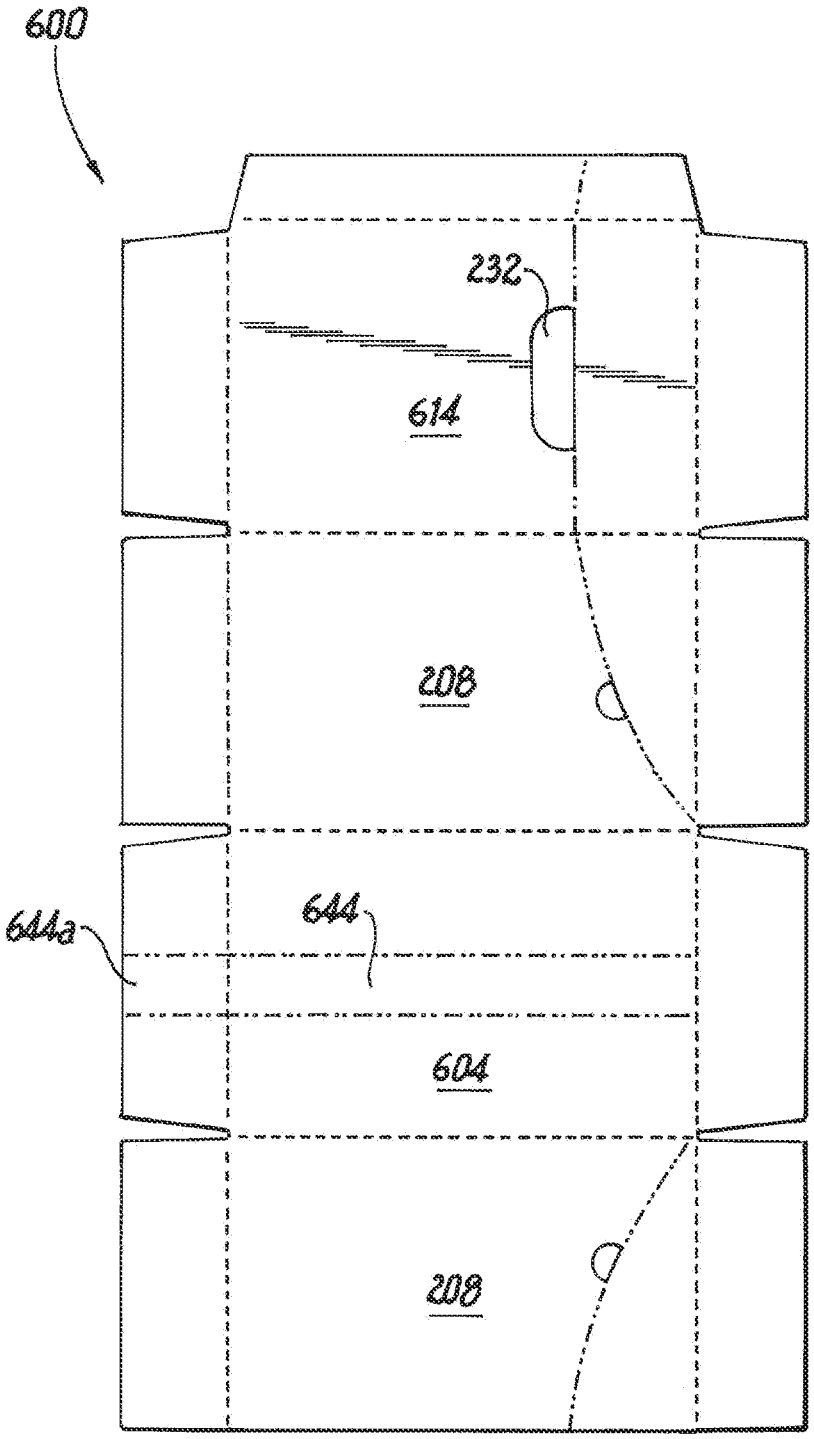
FIG. 37 is a schematic plan view of an embodiment of a blank constructed in accordance with the present disclosure, showing the interior surface of the blank with separation lines.
Figure 38:
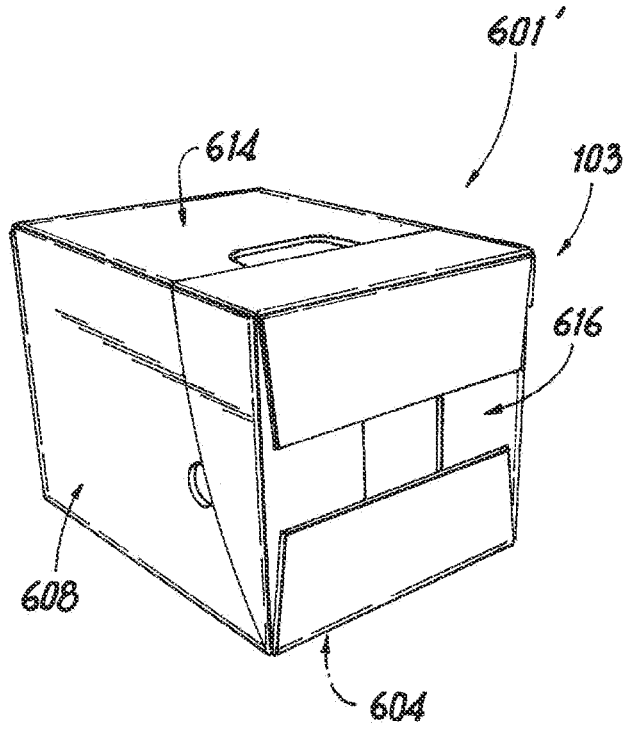
FIG. 38 is a schematic perspective view of the rear and top of a container of formed by the blank of FIG. 37, showing the erected container with product inside.
Figure 39:
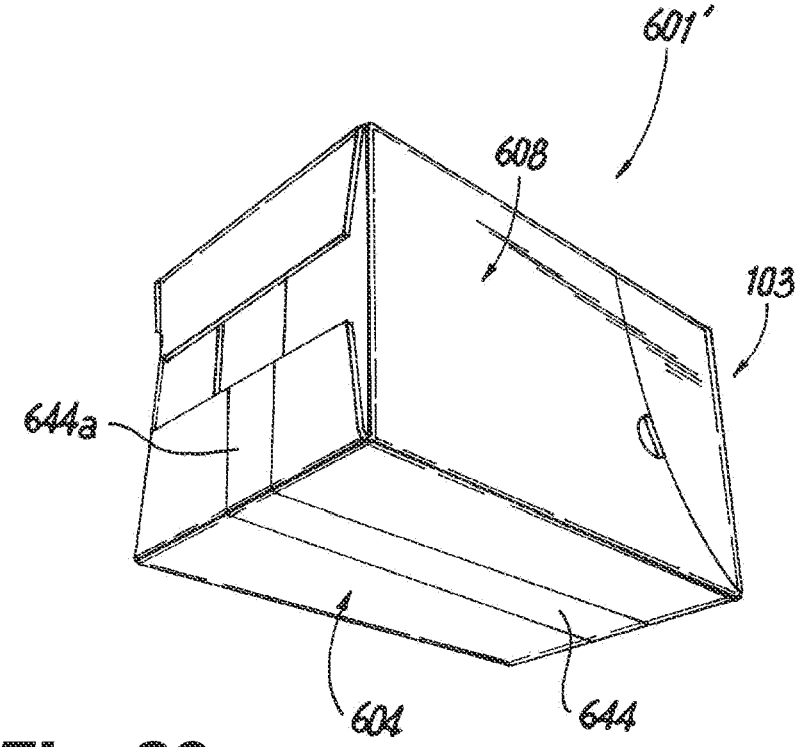
FIG. 39 is a schematic perspective view of the front and bottom of the container of formed by the blank of FIG. 37, showing the erected container with product inside.
Figure 40:
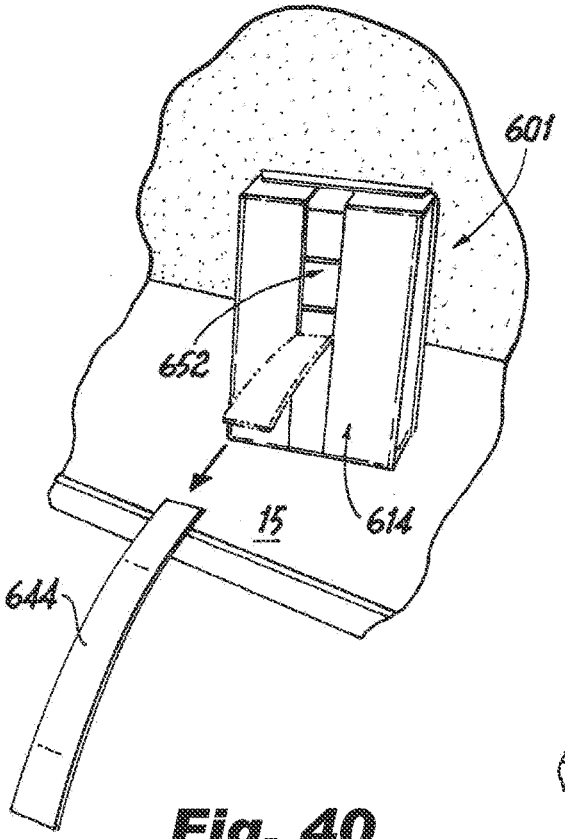
FIGS. 40-44 are schematic perspective views of the container of FIGS. 38-39, showing stages of using the container to facilitate retail display of the product.
Figure 41:
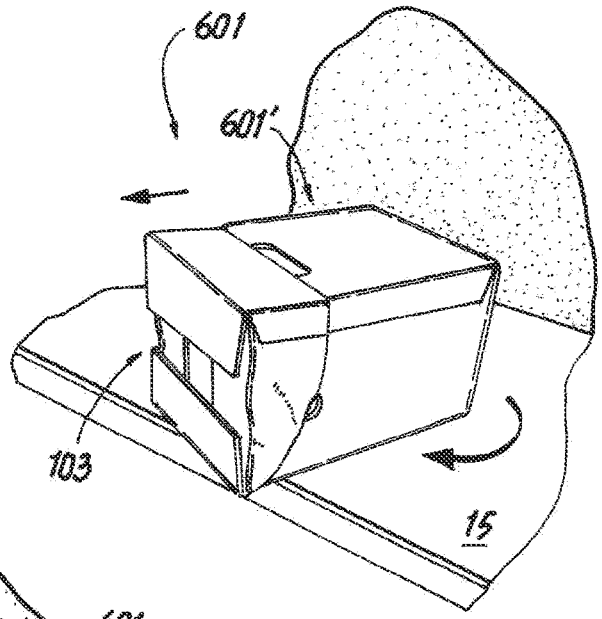
Figure 42:
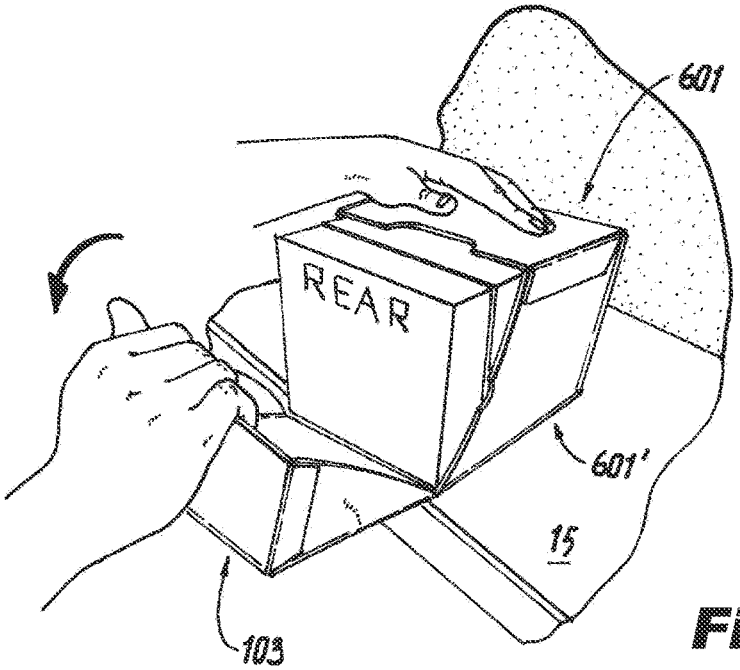
Figure 43:
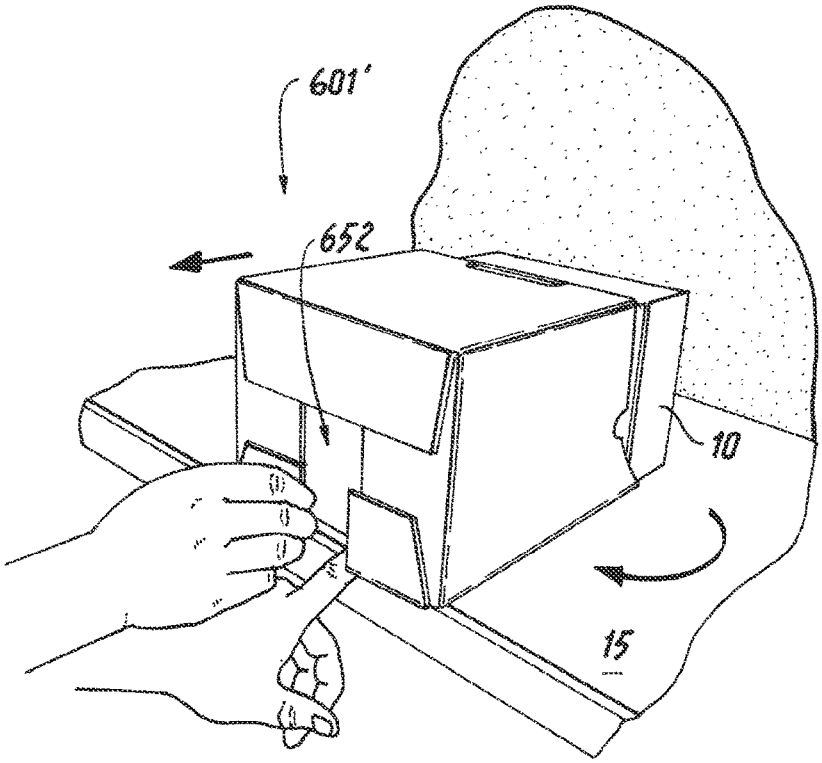
Figure 44:
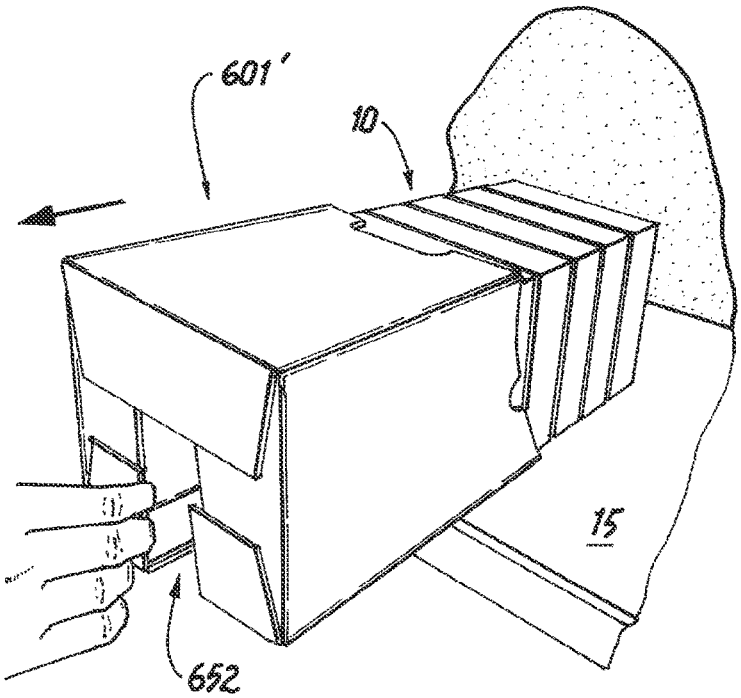
Figure 45:
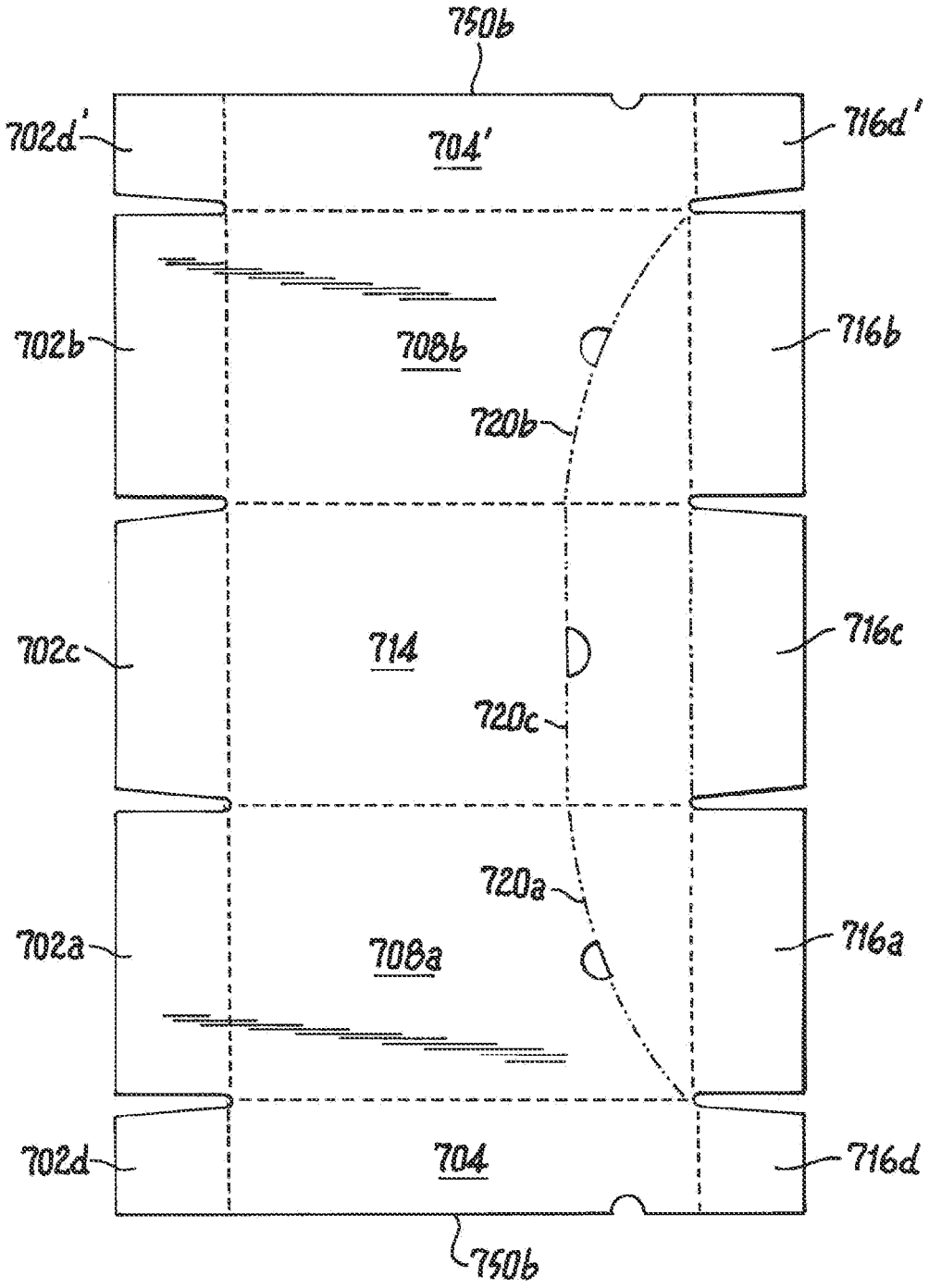
FIG. 45 is a schematic plan view of an embodiment of a blank constructed in accordance with the present disclosure, showing the interior surface of the blank with separation lines.
Figure 46:
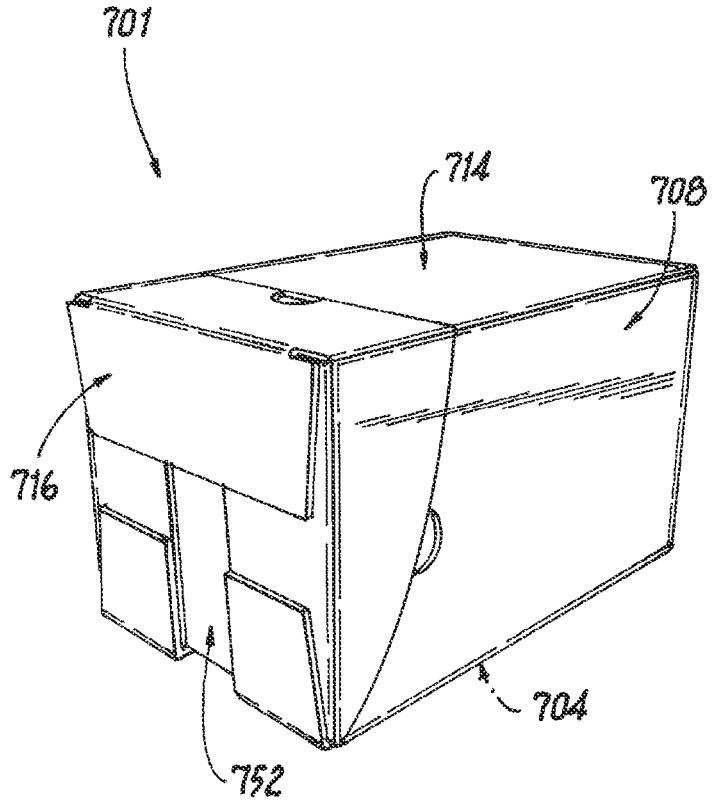
FIG. 46 is a schematic perspective view of the rear and top of a container of formed by the blank of FIG. 45, showing the erected container with product inside.
Figure 47:
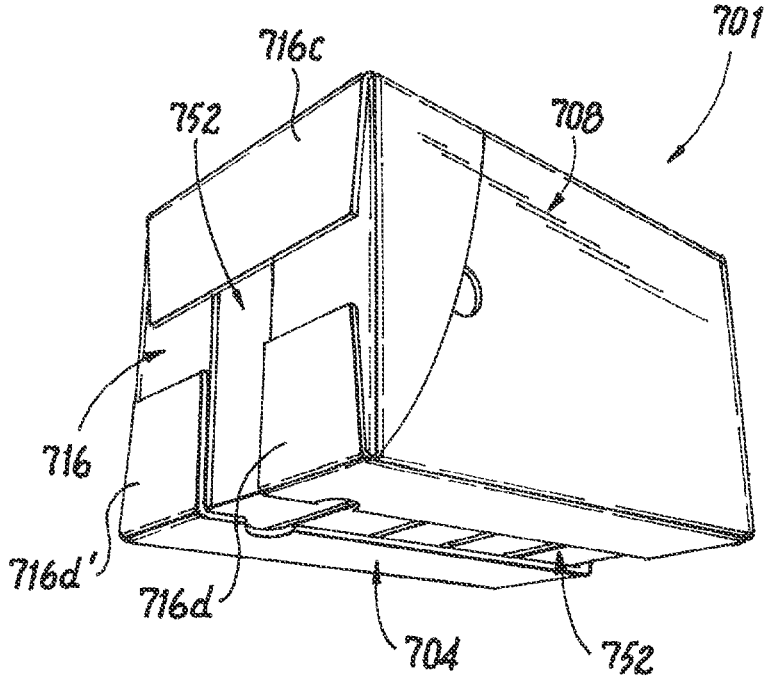
FIG. 47 is a schematic perspective view of the rear and bottom of the container of formed by the blank of FIG. 45, showing the erected container with product inside.

In embodiments, such as seen in FIGS. 29-30, the bottom flaps 104*a*, 104*b* can be folded so that they are closer to the interior space of the container 501 than bottom flaps 104*c*, 104*d* so that the product 10 rests atop bottom flaps 104*a*, 104*b*. Such a configuration allows for bottom flaps 104*a*, 104*b* to act as rails, so that when the container 501' is removed off of the product 10, the product 10 does not get caught on flaps 104*c*, 104*d*, providing a smoother removal of the portion 501'.

As shown in FIGS. 33-36, once removable portion 103 is off, a user pulls the remainder 501' of container 501 (e.g. the front portions of top panels 114*a* and 114*b*, the front portions of side panels 108*a* and 108*b*, bottom flaps 104*a*-104*d*, front panel 102 and glue flap 148) at finger slot 552, while applying an opposing force to products 10 so that they remains on shelf 15. Finger slot 552 allows for a user to access the interior of the container 501 from a front and bottom side to apply a force to the products 10 of the container 501 while sliding off the remainder 501' of container 501 that is left after removable portion 103 of container 501 is broken away. This allows a user to stock a shelf 15, in particular higher shelves for example, with products 10 in an efficient manner without leaving a tray underneath the products 10, and without the user having to over extend to reach a top of the box.

As shown in FIGS. 37-44, a blank 600 for constructing a container 601, can be similar to that of blank 200 for constructing container 201, for example blank 600 can have similar components and features, and may be erected in a similar manner to that described with respect to blank 200 and container 201. For brevity, the description of common elements that have been described above are not repeated with respect to FIGS. 37-44. In blank 600, removable portion 644 can be defined in bottom panel 604, instead of top panel 614, while the handle hole 232 remains defined in top panel 614.

As shown in FIGS. 45-53, a blank 700 for constructing a container 701, can be similar to that of blank 300 for constructing container 301, for example blank 700 can have similar components and features, and may be erected in a similar manner to that described with respect to blank 300 and container 301. For brevity, the description of common elements that have been described above are not repeated with respect to FIGS. 45-53. In blank 700, the separation line 720*a*, 720*b*, extends across side panel 708*a* and 708*b*, but also spans an entirety of the width of top panel 714 along 720*c*.

Figure 48:
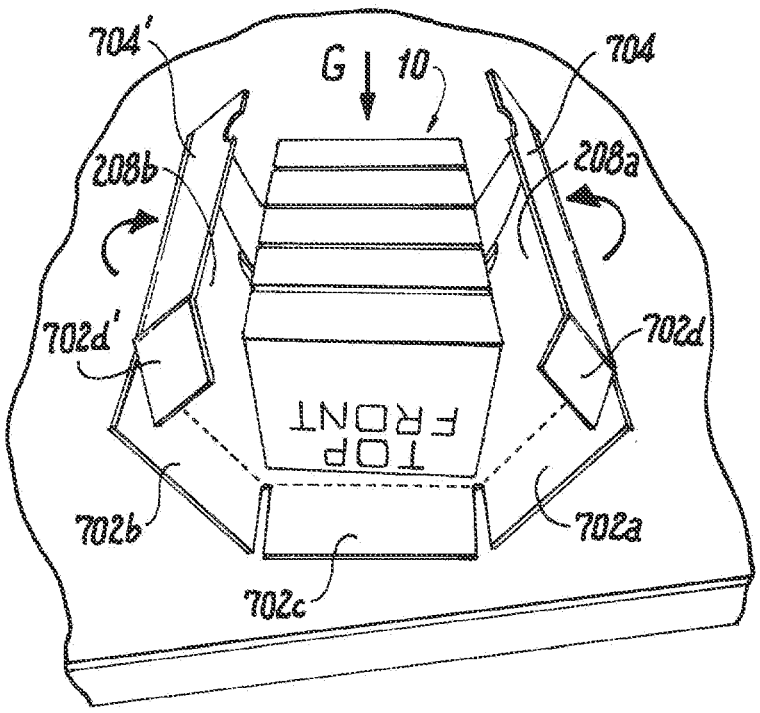
Figure 49:
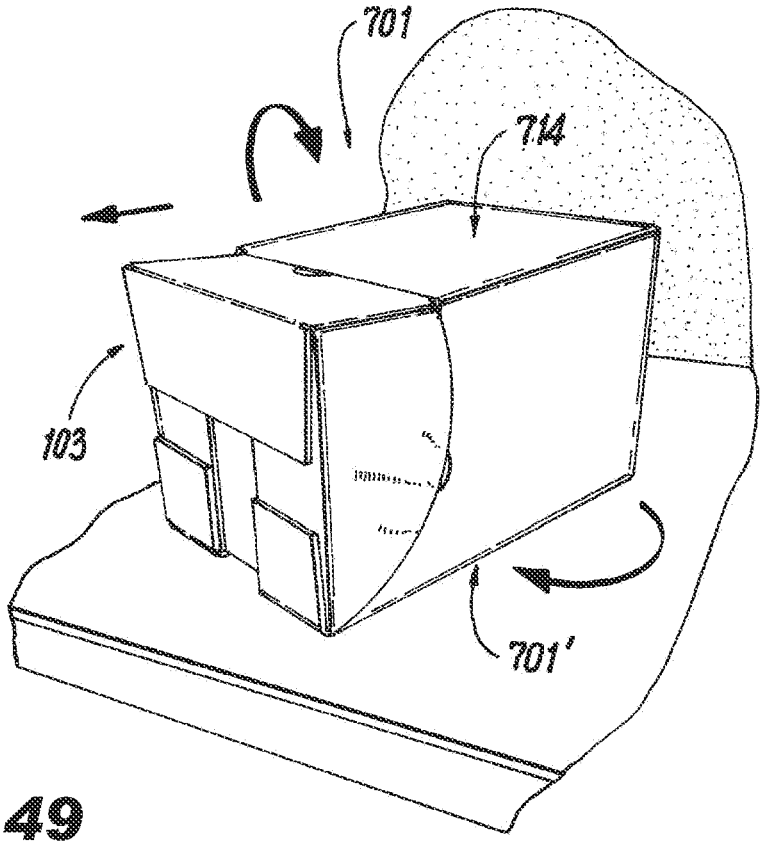
Figure 52:
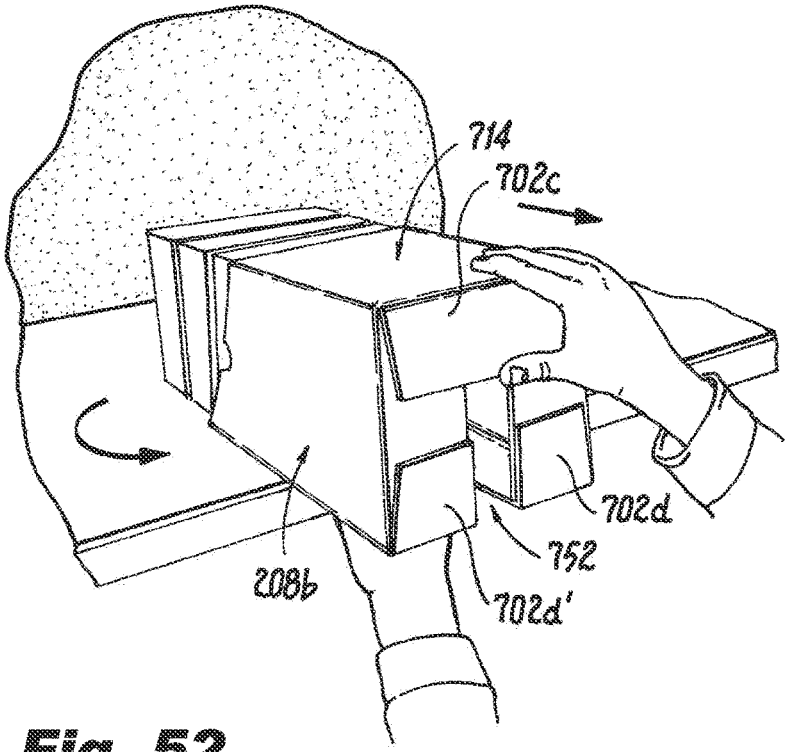

When the container 701 is erected, product 10 can be packaged upside down atop top panel 714, and side panels 708*a* and 708*b* can be folded up and around the side of product 10. Bottom panels 704, 704' can be folded around the bottom of the product, without coming fully together, to form finger slot 752 between terminal edges 750*a*, 750*b*, for example as shown in FIGS. 48-49. Once the container 701 is erected around the product 10, the container 701 can be flipped so that the product 10 is right side up, and finger slot 752 is in contact with the shelf 15. This step can be can be performed by a packaging machine, prior to shipping so that product 10 is right side up relative to the direction of gravity during transit to prevent settling. Because bottom panels 704 and 704' come together form finger slot 752, front flaps 702*d* and 702*d'* similarly come together, meaning there need not be any removable portion defined in any of blank 700. Instead, finger slot 752 can be formed in the bottom panel 704 solely via the position of the glued flaps 702 and 704 in the erected container 701.

The methods and systems of the present disclosure, as described above and shown in the drawings, provide for retail ready containers with superior properties including providing quick and efficient stocking of shelves. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A blank for constructing a container, comprising: a front panel; a bottom panel foldably connected to the front panel along a lower front horizontal fold line; a side panel having a front portion and a rear portion, wherein the side panel is foldably connected to at least one of the bottom panel or the front panel; a top panel wherein the top panel is foldably connected to the side panel; and a rear panel foldably connected to the rear portion of the side panel along a rear vertical fold line, wherein the front and rear portions of the side panel are separable from one another along a separation line such that the rear portion of the side panel and the rear panel are configured and adapted for removal, wherein the rear panel is configured to form at least part of a rear wall in a formed container, wherein the top panel is configured to form at least part of a top wall in the formed container, wherein the front panel is configured to form at least part of a front wall in the formed container, wherein the bottom panel is configured to form at least part of a bottom wall in the formed container, wherein the side panel is configured to form at least part of a side wall in the formed container, wherein an entirety of the rear wall is configured and adapted for removal, wherein the blank is configured to define a finger slot in the formed container, wherein the finger slot is configured to extend through at least one of the front wall, the top wall, the bottom wall, and/or the side wall to allow a user to access an interior of the formed container.

2. The blank as recited in claim 1, wherein the rear panel is foldably connected to the bottom panel along a separation line.

3. The blank as recited in claim 1, wherein the rear panel is a first of a plurality of rear flaps, wherein a second of the plurality of rear flaps is foldably connected to the bottom panel along a separation line.

4. The blank as recited in claim 1, wherein the bottom panel is a first of a plurality of bottom flaps, wherein a second of the plurality of bottom flaps is foldably connected to the rear panel along a separation line.

5. The blank as recited in claim 1, further comprising a finger hole in the side panel between the front portion of the side panel and the rear portion of the side panel.

6. The blank as recited in claim 1, wherein the top panel is a first of a plurality of top flaps.

7. The blank as recited in claim 1, wherein the front panel is a first of a plurality of front flaps.

8. The blank as recited in claim 1, wherein at least one of the front portion of the side panel or a front portion of the bottom panel includes a removable portion defined between two separation lines.

9. The blank as recited in claim 8, wherein the removable portion extends from a finger hole towards the bottom panel, wherein the rear panel is foldably connected to the bottom panel along a separation line, wherein the separation line between the front and rear portions of the side panel extends from the separation line on the bottom panel towards the top panel.

10. The blank as recited in claim 1, wherein the top panel includes a front portion and a rear portion separable from one another along a separation line.

11. The blank as recited in claim 10, wherein at least a portion of a handle hole is defined between the front and rear portions of the top panel.

12. The blank as recited in claim 10, wherein the front and rear portions of the top panel connect to the front and rear portions of the side panel, respectively, along respective fold lines.

13. The blank as recited in claim 12, wherein the bottom panel is a first of a plurality of bottom flaps, wherein a second bottom flop is foldably connected to the side panel, wherein the front portion of the top panel is longer the rear portion of the top panel, wherein a length of the second bottom flap is greater than a length of the front portion of the top panel.

14. The blank as recited in claim 13, wherein a length of the front portion of the side panel proximate the bottom panel is greater than a length of the front portion of the side panel proximate the top panel.

15. A container, comprising: a plurality of panels connected together to enclose an interior space, wherein the plurality of panels include: a front panel; a bottom panel foldably connected to the front panel along a lower front horizontal fold line; a side panel having a front portion and a rear portion, wherein the side panel is foldably connected to at least one of the bottom panel or the front panel; a top panel, wherein the top panel is foldably connected to the side panel; and a rear panel foldably connected to the rear portion of the side panel along a rear vertical fold line, wherein the front and rear portions of the side panel are configured and adapted to be separated from one another along a separation line such that the rear portion of the side panel and the rear panel are configured and adapted for removal to provide access to the interior space, wherein the rear panel forms at least part of a rear wall, wherein the top panel forms at least part of a top wall, wherein the front panel forms at least part of a front wall, wherein the bottom panel forms at least part of a bottom wall in the formed container, wherein the side panel forms at least part of a side wall in the formed container, wherein an entirety of the rear wall is configured and adapted for removal, wherein finger slot is configured to extend through at least one of the top wall, the front wall, the bottom wall, and/or the side wall to allow a user to access the interior space.

16. The container as recited in claim 15, wherein the side panel includes a glue flap extending from and foldably connected to the front portion of the side panel, wherein the glue flap is adhered to an inside surface of the front panel.

17. The container as recited in claim 15, wherein the top panel includes a glue flap extending from and foldably connected to the top panel, wherein the glue flap is adhered to an inside surface of the side panel.

18. The container as recited in claim 15, wherein the bottom panel is a first of a plurality of bottom flaps, wherein the first of the plurality of bottom flaps and a second of the plurality of bottom flaps each define a terminal edge, wherein the finger slot is defined between the terminal edges of the first and second bottom flaps.

19. The container as recited in claim 15, wherein the bottom panel is a first of a plurality of bottom flaps, wherein the first bottom flap is foldably connected to the side panel and a second bottom flap is foldably connected to either of the front panel or the rear panel, wherein first bottom flap is closer to the interior space of the container than the second bottom flap, such that a product held within the container rests atop the first bottom flap.

20. The container as recited in claim 15, wherein both the finger slot and a product held within the container settle towards the bottom of the container relative to a direction of gravity.

* * * * *